US005654723A

United States Patent [19]

Craven et al.

[11] Patent Number: 5,654,723

[45] Date of Patent: Aug. 5, 1997

[54] CONTRAWOUND ANTENNA

[75] Inventors: Robert P. M. Craven, Star City, W. Va.; Michael T. Prinkey, Normalville, Pa.; James E. Smith, Morgantown, W. Va.

[73] Assignee: West Virginia University, Morgantown, W. Va.

[21] Appl. No.: 483,200

[22] Filed: Jun. 7, 1995

Related U.S. Application Data

[63] Continuation-in-part of Ser. No. 992,970, Dec. 15, 1992, Pat. No. 5,442,369.

[51] Int. Cl.[6] ..... H01Q 11/12

[52] U.S. Cl. ..... 343/742; 343/744; 343/866

[58] Field of Search ..... 343/742, 743, 343/744, 788, 866, 867, 870, 840, 895

[56] References Cited

U.S. PATENT DOCUMENTS

| | | | |
|---|---|---|---|
| 3,284,801 | 11/1966 | Bryant | 343/743 |
| 3,646,562 | 2/1972 | Acker et al. | 343/720 |
| 3,671,970 | 6/1972 | Layton | 343/120 |
| 3,721,989 | 3/1973 | Christensen | 343/701 |
| 4,622,558 | 11/1986 | Corum | 343/742 |
| 4,742,359 | 5/1988 | Ishino et al. | 343/895 |
| 4,751,515 | 6/1988 | Corum | 343/742 |
| 4,999,642 | 3/1991 | Wells | 343/822 |
| 5,159,332 | 10/1992 | Walton | 340/825.54 |
| 5,442,369 | 8/1995 | Voorhies et al. | 343/866 |

FOREIGN PATENT DOCUMENTS

| | | | |
|---|---|---|---|
| 043591A1 | 1/1982 | European Pat. Off. | H01Q 11/08 |
| 3823972A1 | 1/1990 | Germany | H01Q 7/00 |

OTHER PUBLICATIONS

"Time–Varying Electric and Magnetic Fields" by J.M. Ham, G. R. Slemon fromn *Scientific Basis of Electrical Engineering:* pp. 302–305; 1961. no month.

Reference Data for Radio Engineers; 7th Ed. E.C. Jordan Ed.: Howard W. Sams; pp. 6–13 –6–14, no date.

"Wide–Frequency–Range Tuned Helical Antennas and Circuits" by A.G. Kandoian, W. Sichak; Fed. Telecommunication Laboratories, Inc.; pp. 42–47; 1953. no month.

"Modified Contra–Wound Helix Circuits for High–Power Traveling–Wave Tubes" by C.K. Birdsall, T.E. Everhart; from IRE Transactions on Electron Devices; pp. 190–206; Oct. 1956.

"Time Harmonic Electromagnetic Fields" by R.F. Harrington; pp. 106–111; 1961. no month.

"Energy and the Environment: A Continuing Partnership" by K. L. Van Voorhies, J.E. Smith; 26th Intersociety Energy Conversion Engineering Conference; 6 pp.; Aug. 1991.

Yung, E.K.N. et al., "A Magnetic Current Loop Array In A Parabolic Reflector", IEEE Antennas and Propagation Society International Symposium, vol. 4, Jul. 20, 1992, pp. 18321835.

*Primary Examiner*—Donald T. Hajec
*Assistant Examiner*—Tan Ho
*Attorney, Agent, or Firm*—Arnold B. Silverman; Kirk D. Houser; Eckert Seamans Cherin & Mellott, LLC

[57] ABSTRACT

An antenna is disclosed that has windings that are contrawound in segments on a toroid form and that have opposed currents on selected segments. An antenna is disclosed that has one or more insulated conductor circuits with windings that are contrawound around and over a surface, such as a spherical surface, a generally spherical surface, a multiply connected surface, a toroidal surface, or a hemispherical surface. The insulated conductor circuits may form one or more endless conductive paths around and over the surface. The windings may have a helical pattern, a generally helical pattern, a partially helical pattern, a poloidal peripheral pattern or may be constructed from a slotted conductor on the toroid. Poloidal loop winds are disclosed with a toroid hub on a toroid that has two plates that provides a capacitive feed to the loops, which are selectively connected to one of the plates.

41 Claims, 26 Drawing Sheets

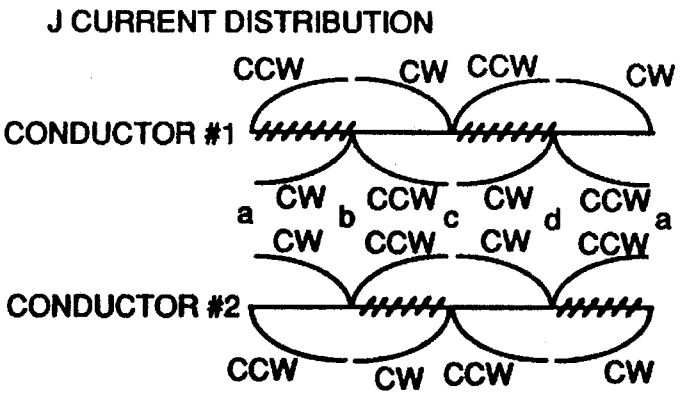
FIG. 7
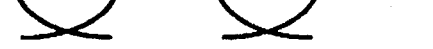
FIG. 8
FIG. 9
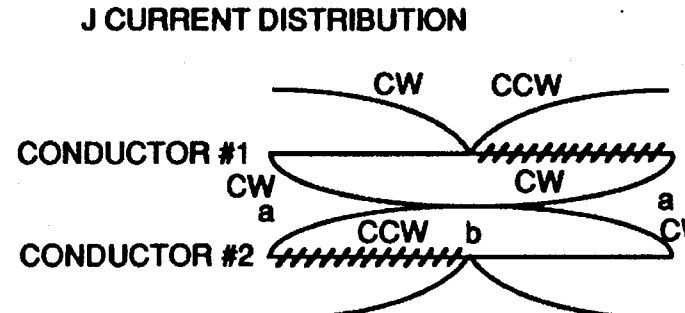
FIG. 10
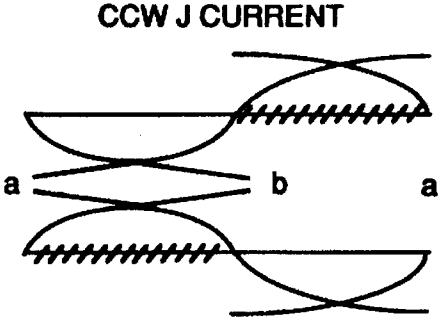
FIG. 11
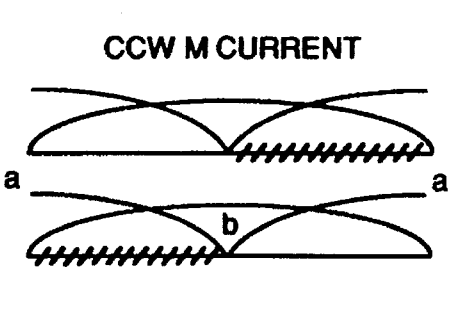
FIG. 12

94′

CONTRAWOUND ANTENNA

This is a continuation-in-part of application Ser. No. 07/992,970, filed Dec. 15, 1992, now U.S. Pat. No. 5,442, 369.

TECHNICAL FIELD

This invention relates to transmitting and receiving antennas, and in particular, helically wound antennas.

BACKGROUND OF THE INVENTION

Antenna efficiency at a frequency of excitation is directly related to the effective electrical length, which is related to the signal propagation rate by the well known equation using the speed of light C in free space, wavelength λ, and frequency f:

$$\lambda = C/f$$

As is known, antenna electrical length should be one wavelength, one half wavelength (a dipole) or one quarter wavelength with a ground plane to minimize all but real antenna impedances. When these characteristics are not met, antenna impedance changes creating standing waves on the antenna and antenna feed (transmission line), increasing the standing wave ratio all producing energy loss and lower radiated energy.

A typical vertical whip antenna (a monopole) possesses an omnidirectional vertically polarized pattern, and such an antenna can be comparatively small at high frequencies, such as UHF. However, at lower frequencies the size becomes problematic, leading to the very long lines and towers used in the LF and MF bands. The long range transmission qualities in the lower frequency bands are advantageous but the antenna, especially a directional array can be too large to have a compact portable transmitter. Even at high frequencies, it may be advantageous to have a physically smaller antenna with the same efficiency and performance as a conventional monopole or dipole antenna.

Over the years different techniques have been tried to create compact antennas with directional characteristics, especially vertical polarization, which has been found to be more efficient (longer range) than horizontal polarization, the reason being the horizontally polarized antennae sustain more ground wave losses.

In terms of directional characteristics, it is recognized that with certain antenna configurations it is possible to negate the magnetic field produced in the antenna in a particular polarization and at the same time increase the electric field, which is normal to the magnetic field. Similarly, it is possible to negate the electric field and at the same time increase the magnetic field.

The equivalence principle is a well known concept in the field of electromagnetic arts stating that two sources producing the same field inside a given region are said to be equivalent, and that equivalence can be shown between electric current sources and corresponding magnetic current sources. This is explained in Section 3–5 of the 1961 reference *Time Harmonic Electromagnetic Fields* by R. F. Harrington. For the case of a linear dipole antenna element which carries linear electric currents, the equivalent magnetic source is given by a circular azimuthal ring of magnetic current. A solenoid of electric current is one obvious way to create a linear magnetic current. A solenoid of electric current disposed on a toroidal surface is one way of creating the necessary circular azimuthal ring of magnetic current.

The toroidal helical antenna consists of a helical conductor wound on a toroidal form and offers the characteristics of radiating electromagnetic energy in a pattern that is similar to the pattern of an electric dipole antenna with an axis that is normal to the plane of and concentric with the center of the toroidal form. The effective transmission line impedance of the helical conductor retards, relative to free space propagation rate, the propagation of waves from the conductor feed point around the helical structure. The reduced velocity and circular current in the structure makes it possible to construct a toroidal antenna as much as an order of magnitude or more smaller that the size of a corresponding remnant dipole (linear antenna). The toroidal design has low aspect ratio, since the toroidal helical design is physically smaller than the simple resonant dipole structure, but with similar electrical radiation properties. A simple single-phase feed configuration will give a radiation pattern comparable to a ½ wavelength dipole, but in a much smaller package.

In that context, U.S. Pat. Nos. 4,622,558 and 4,751,515 discusses certain aspects of toroidal antennas as a technique for creating a compact antenna by replacing the conventional linear antenna with a self resonant structure that produces vertically polarized radiation that will propagate with lower losses when propagating over the earth. For low frequencies, serf-resonant vertical linear antennas are not practical, as noted previously, and the self-resonant structure explained in these patents goes some way to alleviating the problem of a physically unwieldy and electrically inefficient vertical elements at low frequencies.

The aforementioned patents initially discuss a monofilar toroidal helix as a building block for more complex directional antennas. Those antennas may include multiple conducting paths fed with signals whose relative phase is controlled either with external passive circuits or due to specific self resonant characteristics. In a general sense, the patents discuss the use of so called contrawound toroidal windings to provide vertical polarization. The contrawound toroidal windings discussed in these patents are of an unusual design, having only two terminals, as described in the reference Birdsall, C. K., and Everhart, T. E., "Modified Contra-Wound Helix Circuits for High-Power Traveling Wave Tubes", *IRE Transactions on Electron Devices*, October, 1956, p. 190. The patents point out that the distinctions between the magnetic and electric fields/currents and extrapolates that physically superimposing two monofilar circuits which are contrawound with respect to one another on a toroid a vertically polarized antenna can be created using a two port signal input. The basis for the design is the linear helix, the design equations for which were originally developed by Kandoian & Sichak in 1953 (mentioned the U.S. Pat. No. 4,622,558).

The prior art, such as the aforementioned patents, speaks in terms of elementary toroidal embodiments as elementary building blocks to more complex structures, such as two toroidal structures oriented to simulate contrawound structures. For instance, the aforementioned patent discusses a torus (complex or simple) that is intended to have an integral number of guided wavelengths around the circumference of the circle defined by the minor axis of the torus.

A simple toroidal antenna, one with a monofilar design, responds to both the electric and magnetic field components of the incoming (received) or outputed (transmitted) signals. On the other hand, muitifilar (multiwinding) may have the same pitch sense or different pitch sense in separate windings on separate toroids, allowing providing antenna directionality and control of polarization. One form of helix is in the form of a ring and bridge design, which exhibits some but not all of the qualities of a basic contrawound winding configuration.

As is known, a linear solenoidal coil creates a linear magnetic field along its central axis. The direction of the magnetic field is in accordance with the "right hand rule", whereby if the fingers of a right hand are curled inward towards the palm and pointed in the direction of the circular current flow in the solenoid, then the direction of the magnetic field is the same as that of the thumb when extended parallel to the axis about which the fingers are curled. (See e.g. FIG. 47, infra.) When this rule is applied for solenoid coils wound in a right-hand sense, as in a right-hand screw thread, both the electric current and the resulting magnetic field point in the same direction, but a coil in a left-hand sense, has the electric current and resulting magnetic field point in opposite directions. The magnetic field created by the solenoidal coil is sometimes termed a magnetic current. By combining a right-hand and left-hand coil on the same axis to create a contra-wound coil and feeding the individual coil elements with oppositely directed currents, the net electric current is effectively reduced to zero, while the net magnetic field is doubled from that of the single coil alone.

As is also known, a balanced electrical transmission line fed by a sinusoidal AC source and terminated with a load impedance propagates waves of currents from the source to the load. The waves reflect at the load and propagate back towards the source, and the net current distribution on the transmission line is found from the sum of the incident and reflected wave components and can be characterized as standing waves on the transmission line. (See e.g. FIG. 13, infra.) With a balanced transmission line, the current components in each conductor at any given point along the line are equal in magnitude but opposite in polarity, which is equivalent to the simultaneous propagation of oppositely polarized by equal magnitude waves along the separate conductors. Along a given conductor, the propagation of a positive current in one direction is equivalent to the propagation of a negative current in the opposite direction. The relative phase of the incident and reflected waves depends upon the impedance of the load element, $Z_L$. For $I_0$=incident current signal and $I_a$=to reflected current signal, with reference to FIG. 13, infra. then the reflection coefficient ρi is defined as:

$$\rho_i = \frac{I_1}{I_0} = \frac{-I_1'}{I_0} = \frac{\frac{Z_L}{Z_0} - 1}{\frac{Z_L}{Z_0} + 1}$$

Since the incident and reflected currents travel in opposite directions, the equivalent reflected current, $I_1'=-I_1$ gives the magnitude of the reflected current with respect to the direction of the incident current $I_0$.

DISCLOSURE OF THE INVENTION

An object of the present invention is to provide a compact vertically polarized antenna, especially suited to low frequency long distance wave applications, but useful at any frequency where a physically low profile or inconspicuous antenna package is desirable.

It is a still further object of the present invention to provide a directional antenna suitable for use of a motor vehicle or ship.

It is yet a further object of the present invention to provide an antenna which is approximately omnidirectional in all directions.

It is another further object of the present invention to provide an antenna having a maximum radiation gain in directions normal to the direction of polarization and a minimum radiation gain in the direction of polarization.

It is still another further object of the present invention to provide an antenna having a simplified feed configuration that is readily matched to a radio frequency (RF) power source.

It is yet another further object of the present invention to provide an antenna which enhances radial energy radiation.

It is yet a still further object of the present invention to provide an antenna which enhances vertical energy radiation.

According to the present invention a toroidal antenna has a toroidal surface and first and second windings that comprise insulated conductors each extending as a single closed circuit around the surface in segmented helical pattern. The toroid has an even number of segments, e.g. four segments, but generally greater than or equal to two segments. Each part of one of the continuous conductors within a given segment is contrawound with respect to that part of the same conductor in the adjacent segments. Adjacent segments of the same conductor meet at nodes or junctions (winding reversal points). Each of the two continuous conductors are contrawound with respect to each other within every segment of the toroid. A pair of nodes (a port) is located at the boundary between each adjacent pairs of segments. From segment to segment, the polarity of current flow from an unipolar signal source is reversed through connections at the port with respect to the conductors to which the port's nodes are connected. According to the invention, the conductors at the junctions located at every other port are severed and the severed ends are terminated with matched purely reactive impedances which provides for a 90 degree phase shift of the respective reflected current signals. This provides for the simultaneous cancellation of the net electric currents and the production of a quasi-uniform azimuthal magnetic current within the structure creating vertically polarized electromagnetic radiation.

According to the invention, a series of conductive loops are "poloidally" disposed on, and equally spaced about, a surface of revolution such that the major axis of each loop forms a tangent to the minor axis of the surface of revolution. Relative to the major axis of the surface of revolution, the centermost ends of all loops are connected together at one terminal, and the remaining ends of all loops are connected together at a second terminal. A unipolar signal source is applied across the two terminals and since the loops are electrically connected in parallel, the magnetic fields produced by all loops are in phase thus producing a quasi-uniform azimuthal magnetic field, causing vertically polarized omnidirectional radiation.

According to the invention, the number of loops is increased, the conductive elements becoming conductive surface of revolution, which could be either continuous or radially slotted. The operating frequency is lowered by introducing either series inductance or parallel capacitance relative to the composite antenna terminals.

According to the invention, capacitance may be added with the addition of a pair of parallel conductive plates which act as a hub to a conductive surface of revolution. The surface of revolution is slit at the junction with the plates, with one plate being electrically connected to one side of the slit, and a second plate being connected to the other side of the slit. The conductive surface of revolution may be further slitted radially to emulate a series of elementary loop antennas. The bandwidth of the structure may be increased if the radius and shape of the surface of revolution are varied with the corresponding angle of revolution.

According to the invention, an electromagnetic antenna includes a multiply connected surface; a first insulated conductor means extending in a first generally helical conductive path around and at least partially over the multiply connected surface with at least a first helical pitch sense; a second insulated conductor means extending in a second generally helical conductive path around and at least partially over the multiply connected surface with at least a second helical pitch sense, which is opposite from the first helical pitch sense, in order that the first and second insulated conductor means are contrawound relative to each other around and at least partially over the multiply connected surface; first and second signal terminals respectively electrically connected to the first and second insulated conductor means; and reflector means for directing the antenna signal with respect to the multiply connected surface for reception or transmission of the antenna signal.

According to the invention, an electromagnetic antenna includes a multiply connected surface having a major axis; a first insulated conductor means extending in a first partially helical conductive path around and at least partially over the muitiply connected surface with at least a first helical pitch sense; a second insulated conductor means extending in a second partially helical conductive path around and at least partially over the multiply connected surface with at least a second helical pitch sense, which is opposite from the first helical pitch sense, in order that the first and second insulated conductor means are contrawound relative to each other around and at least partially over the multiply connected surface, with the first and second partially helical conductive paths, when generally perpendicular to the major axis of the multiply connected surface, being generally radial with respect to the major axis of the multiply connected surface, and otherwise being generally helically oriented; and first and second signal terminals respectively electrically connected to the first and second insulated conductor means.

According to the invention, an electromagnetic antenna includes a generally spherical surface having a conduit along a major axis thereof; a first insulated conductor means extending in a first partially helical conductive path around and at least partially over the generally spherical surface with at least a first helical pitch sense; a second insulated conductor means extending in a second partially helical conductive path around and at least partially over the generally spherical surface with at least a second helical pitch sense, which is opposite from the first helical pitch sense, in order that the first and second insulated conductor means are contrawound relative to each other around and at least partially over the generally spherical surface, with the first and second partially helical conductive paths passing through the conduit of the generally spherical surface and being generally parallel to the major axis thereof within the conduit, and otherwise being generally helically oriented; and first and second signal terminals respectively electrically connected to the first and second insulated conductor means.

According to the invention, an electromagnetic antenna includes a multiply connected surface having a major radius which is greater than zero and a minor radius which is greater than the major radius; a first insulated conductor means extending in a first generally helical conductive path around and at least partially over the multiply connected surface with at least a first helical pitch sense; a second insulated conductor means extending in a second generally helical conductive path around and at least partially over the multiply connected surface with at least a second helical pitch sense, which is opposite from the first helical pitch sense, in order that the first and second insulated conductor means are contrawound relative to each other around and at least partially over the multiply connected surface; and first and second signal terminals respectively electrically connected to the first and second insulated conductor means.

According to the invention, an electromagnetic antenna includes a spherical surface; a first insulated conductor means extending in a first conductive path around and at least partially over the spherical surface with at least a first winding sense; a second insulated conductor means extending in a second conductive path around and at least partially over the spherical surface with at least a second winding sense, which is opposite from the first winding sense, in order that the first and second insulated conductor means are contrawound relative to each other around and at least partially over the spherical surface; and first and second signal terminals respectively electrically connected to the first and second insulated conductor means.

According to the invention, an electromagnetic antenna includes a hemispherical surface; a first insulated conductor means extending in a first conductive path around and at least partially over the hemispherical surface with at least a first winding sense; a second insulated conductor means extending in a second conductive path around and at least partially over the hemispherical surface with at least a second winding sense, which is opposite from the first winding sense, in order that the first and second insulated conductor means are contrawound relative to each other around and at least partially over the hemispherical surface; and first and second signal terminals respectively electrically connected to the first and second insulated conductor means.

The invention provides a compact, vertically polarized antenna with greater gain for a wider frequency spectrum as compared to a bridge and ring configuration. Other objects, benefits and features of the invention will be apparent to one skilled in the art.

BRIEF DESCRIPTION OF THE DRAWING

FIGS. 7, 8 and 9 are current and magnetic field plots relative to toroidal node positions for the antenna shown in FIG. 1.

FIGS. 10, 11 and 12 are current and magnetic field plots relative to toroidal positions between nodes for the antenna shown in FIG. 4.

BEST MODE FOR CARRYING OUT THE INVENTION

Figure 1:
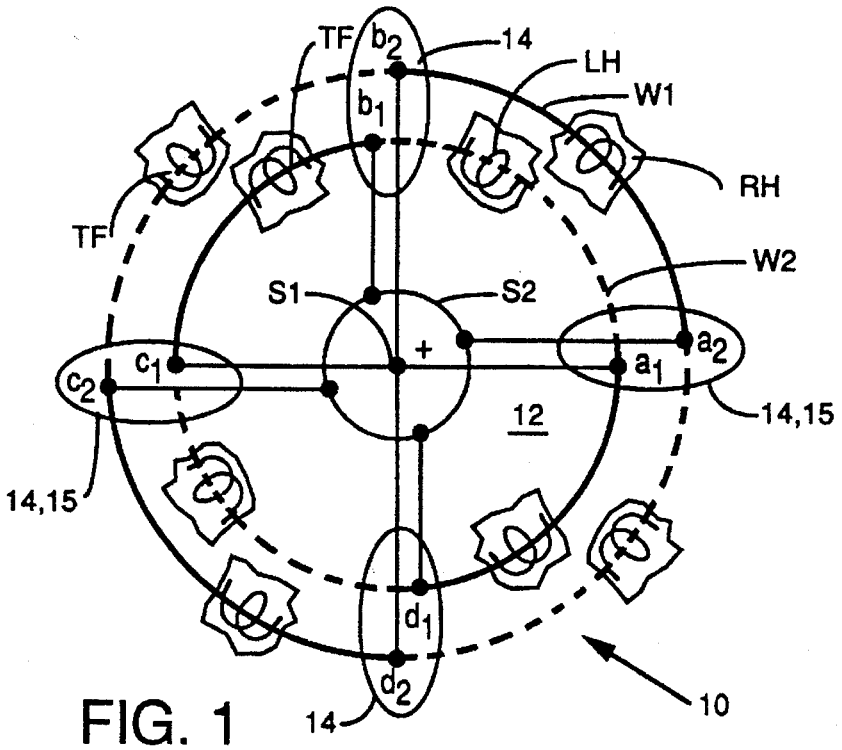
FIG. 1 is a schematic of a four segment helical antenna according to the invention.
Figure 2:
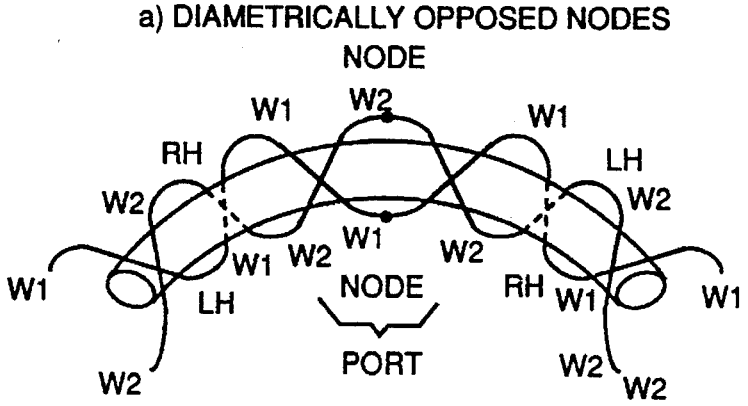
FIG. 2 is an enlarged view of windings in FIG. 1.
Figure 3:
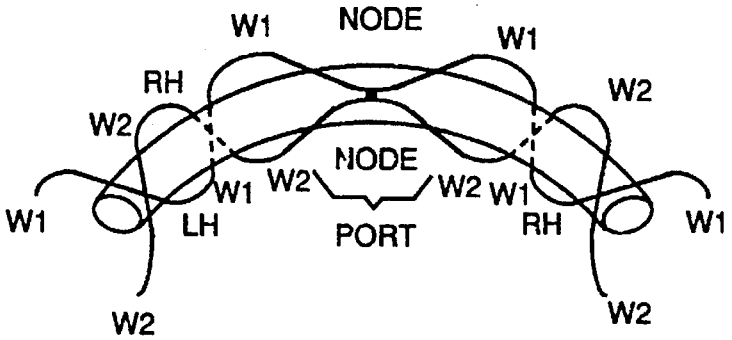
FIG. 3 is an enlarged view of whigs in an alternative embodiment of the invention.
Figure 5:
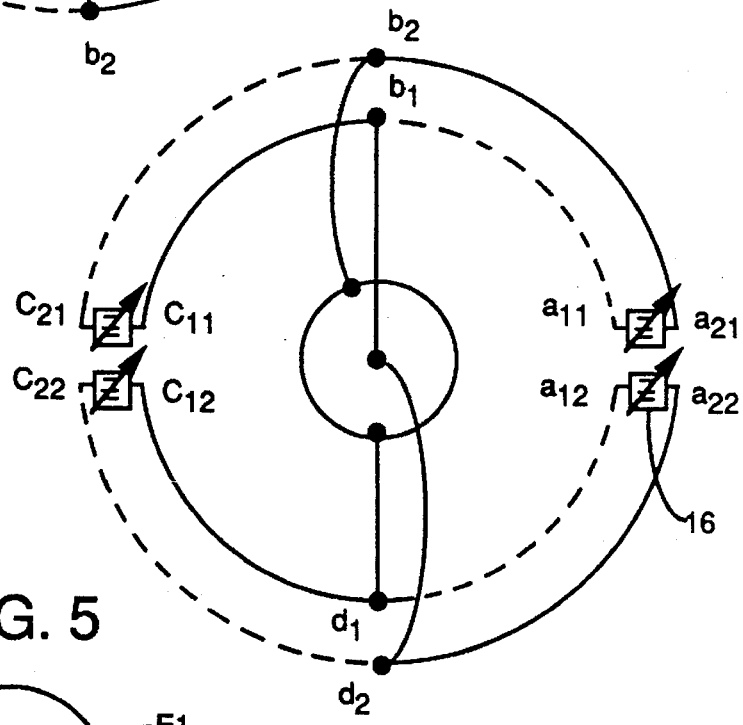
FIG. 5 is two port helical antenna with variable impedances at winding reversal points in an alternate embodiment and for antenna tuning according to the invention.

Referring to FIG. 1, an antenna 10 comprises two electrically insulated closed circuit conductors (windings) W1 and W2 that extend around a toroid form TF through 4 (n=4) equiangular segments 12. The windings are supplied with an RF electrical signal from two pins S1 and S2. Within each segment, the winding "contrawound", that is the source for winding W1 may be right hand (RH), as shown by the dark solid lines, and the same for winding W2 may be left hand (LH) as shown by the broken lines. Each conductor is assumed to have the same number of helical turns around the form, as determined from equations described below. At a junction or node 14 each winding reverses sense (as shown in the cutaway of each). The signal terminals S1 and S2 are connected to the two nodes and each pair of such nodes is termed a "port". In this discussion, each pair of nodes at each of four ports is designated a1 and a2, b1 and b2, c1 and c2 and d1 and d2. In FIG. 1, for instance, there are four ports, a, b, c and d. Relative to the minor axis of TF, at a given port the nodes may be in any angular relation to one another and to the torus, but all ports on the structure will bear this same angular relation if the number of alms in each segment is an integer. For example, FIG. 2 shows diametrically opposed nodes, while FIG. 3 shows overlapping nodes. The nodes overlay each other, but from port to port the connections of the corresponding nodes with terminals or pins S1 and S2 are reversed as shown, yielding a configuration in which diametrically opposite segments have the same connections in parallel, with each winding having the same sense. The result is that in each segment the currents in the windings are opposed but the direction is reversed along with the winding sense from segment to segment. It is possible to increase or decrease the segments so long as there are an even number of segments, but it should be understood that the nodes bear a relationship to the effective transmission line length for the toroid (taking into account the change in propagation velocity due to the helical winding and operating frequency). By altering the node locations the polarization and directionality of the antenna can be controlled, especially with an external impedance 16, as shown in FIG. 5. The four segment configuration shown here, has been found to produce a vertically polarized omnidirectional field pattern having an elevation angle θ from the axis of the antenna and a plurality of electromagnetic waves E1, E2 which emanate from the antenna as illustrated in FIG. 6.

Figure 4:
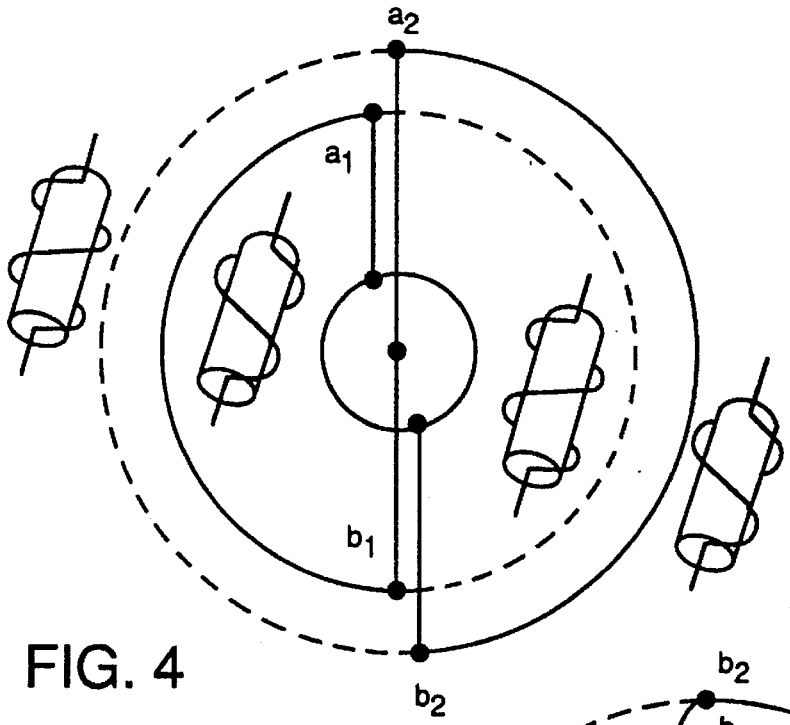
FIG. 4 is a schematic of a two segment (two part) helical antenna embodying the invention.

While FIG. 1 illustrates an embodiment with four segments and FIG. 4 two segments, it should be recognized that the invention can be carried out with any even number of segments, e.g. six segments. One advantage to increasing the number of segments will be to increase the radiated power and to reduce the composite impedance of the antenna feed ports and thereby simplify the task of matching impedance at the signal terminal to the composite impedance of the signal ports on the antenna. The advantage to reducing the number of segments is in reducing the overall size of the antenna.

Figure 6:
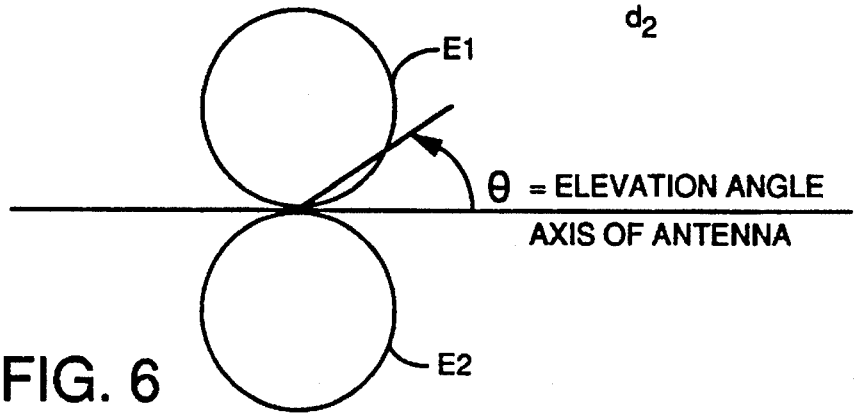
FIG. 6 is a field plot showing the field pattern for the antenna shown in FIG. 1.

While the primary design goal is to produce a vertically polarized omnidirectional radiation pattern as illustrated in FIG. 6, it has been heretofore recognized through the principle of equivalence of electromagnetic systems and understanding of the elementary electric dipole antenna that this can be achieved through the creation of an azimuthal circular ring of magnetic current or flux. Therefore, the antenna will be discussed with respect to its ability to produce such a magnetic current distribution. With reference to FIG. 1, a balanced signal is applied to the signal terminals S1 and S2. This signal is then communicated to the toroidal helical feed ports a through d via balanced transmission lines. As is known from the theory of balanced transmission lines, at any given point along the transmission line, the currents in the two conductors are 180 degrees out of phase. Upon reaching the nodes to which the Transmission line connects, the current signal continues to propagate as a traveling wave in both directions away from each node. These current distributions along with their direction are shown in FIGS. 7 to 9 for a four segment and FIGS. 10–12 for the two segment antenna respectively and are referenced in these plots to the ports or nodes, where J refers to electric current and M refers to magnetic current. This analysis assumes that the signal frequency is tuned to the antenna structure such than the electrical circumference of the structure is one wavelength in length, and that the current distribution on the structure in sinusoidal in magnitude, which is an approximation. The contrawound toroidal helical winds of the antenna structure are treated as a transmission line, however these form a leaky transmission line due to the radiation of power. The plots of FIGS. 7 and 10 show the electric current distribution with polarity referenced to the direction of propagation away from the nodes from which the signals emanate. The plots of FIGS. 8 and 11 show the same current distribution when referenced to a common counter-clockwise direction, recognizing that the polarity of the current changes with respect to the direction to which it is referenced. FIGS. 9 and 12 then illustrate the corresponding magnetic current distribution utilizing the principles illustrated in FIG. 1. FIGS. 8 and 11 show that the net electric current distribution on the toroidal helical structure is canceled. But as FIGS. 9 and 12 show, the net magnetic current distribution is enhanced. Thus those signals in quadrature sum up to form a quasi-uniform azimuthal current distribution.

The following five key elements should be satisfied to carry out the invention: 1) the antenna must be tuned to the signal frequency, i.e. at the signal frequency, the electrical circumferential length of each segment of the toroidal helical structure should be one quarter wavelength, 2) the signals at each node should be of uniform amplitude, 3) the signals at each port should be of equal phase, 4) the signal applied to the terminals S1 and S2 should be balanced, and 5) the impedance of the transmission line segments connecting the signal terminals S1 and S2 to the signal ports on the toroidal helical structure should be matched to the respective loads at each end of the transmission line segment in order to eliminate signal reflections.

When calculating the dimensions for the antenna, the following the following parameters are used in the equations that are used below.

a=the major axis of a torus;

b=the minor axis of the torus

D=2×b=minor diameter of the torus

N=the number of turns of the helical conductor wrapped around the torus;

n=number turns per unit length $V_g$=the velocity factor of the antenna;

a(normalized)=a/λ=$\tilde{a}$ b(normalized)=b/λ=b $L_w$=normalized conductor length $\lambda_g$=the wavelength based on the velocity factor and λ for free space.

m=number of antenna segments

The toroidal helical antenna is at a "resonant" frequency as determined by the following three physical variables:

a=major radius of torus b=minor radius of torus

N=number of radius of helical conductor wrapped around torus

V=guided wave velocity

It has been found that the number of independent variables can be further reduced to two, $V_g$ and N, by normalizing the variables with respect to the free space wavelength λ, and rearranging to form functions $a(V_g)$ and $b(V_g, N)$. That is, this physical structure will have a corresponding resonant frequency, with a free space wavelength of λ. For a four segment antenna, resonance is defined as that frequency where the circumference of the torus' major axis is one wavelength long. In general, the resonant operating frequency is that frequency at which a standing wave is created on the antenna structure for which each segment of the antenna is ¼ guided wavelength long (i.e. each node 12 in FIG. 1 is at the ¼ guided wavelength). In this analysis, it is assumed that the structure has a major circumference of one wavelength, and that the feeds and windings are correspondingly configured.

The velocity factor of the antenna is given by:

$$V_g=\frac{V}{c}=\frac{2\pi a}{\lambda}=\frac{4}{m}\ \frac{L}{\lambda}=\frac{\lambda_g}{\lambda} \tag{1}$$

The physical dimensions of the torus may be normalized with respect to the free space wavelengths as follows:

$$\tilde{a}=\frac{a}{\lambda}\quad \tilde{b}=\frac{b}{\lambda} \tag{2}$$

The reference "Wide-Frequency-Range Tuned Helical Antennas and Circuits" by A. G. Kandoian and W. Sichak in Convention Record of the I.R.E., 1953 National Convention, Part 2—Antennas and Communications, pp. 42–47 presents a formula which predicts the velocity factor for a coaxial line with a monofilar linear helical inner conductor. Through substitution of geometric variables, this formula was transformed to a toroidal helical geometry in U.S. Pat. Nos. 4,622,558 and 4,751,515 to give:

$$V_g=\frac{1}{\sqrt{1+20\left(\frac{2bN}{L}\right)^{2.5}\left(\frac{2b}{\lambda}\right)^{5}}} \tag{3}$$

While this formula is based upon a different physical embodiment than the invention described herein, it is useful with minor empirical modification as an approximate description of the present invention for purposes of design to achieve a given resonant frequency.

Substituting (1) and (2) into equation (3) and simplifying, gives:

$$V_g=\frac{1}{\sqrt{1+20\left(\frac{2\tilde{b}N}{.25mV_g}\right)^{2.5}(2\tilde{b})^{5}}}=\frac{1}{\sqrt{1+160\left(\frac{N}{.25mV_g}\right)^{2.5}\tilde{b}^{3}}} \tag{4}$$

From equation (1) and (2), the velocity factor and normalized major radius are dime fly proportional to one another:

$$V_g=2\pi\tilde{a} \tag{5}$$

Thus, equations (4) and (5) may be rearranged to solve for the normalized major and minor torus radii in terms of $V_g$ and N:

$$\tilde{a}=\frac{mV_g}{8\pi} \tag{6}$$

$$\tilde{b}=\left(\frac{(1-V_g^2)\sqrt{V_g}}{160\left(\frac{4}{m}N\right)^{2.5}}\right)^{\frac{1}{3}} \tag{7}$$

subject to the fundamental property of a torus that:

$$\frac{\tilde{b}}{\tilde{a}}=\frac{b}{a}\leqq 1 \tag{8}$$

Equations (2), (6), (7), (8) provide the fundamental, frequency independent design relationships. They can be used to either find the physical size of the antenna, for a given frequency of operation, velocity factor, and number of turns, or to solve the inverse problem of determining the operating frequency given an antenna of a specific dimension having a given number of helical turns.

A further constraint based upon the referenced work of Kandoian and Sichak may be expressed in terms of the normalized variables as follows:

$$\frac{nD^2}{\lambda}=\frac{4Nb^2}{L\lambda}=\frac{4N\tilde{b}^2}{.25mV_g}\leqq\frac{1}{5} \tag{9}$$

Rearranging this to solve for b, and substituting equation (7) gives:

$$\tilde{b}=\left(\frac{(1-V_g^2)\sqrt{V_g}}{160\left(\frac{4}{m}N\right)^{2.5}}\right)^{\frac{1}{3}}\leqq\left(\frac{mV_g}{80N}\right)^{\frac{1}{2}} \tag{10}$$

Rearranging equation (10) to separate variables gives:

$$\frac{1-V_g^2}{V_g}\leqq\frac{16}{\sqrt{5}}\ \frac{N}{m}=\alpha \tag{11}$$

The resulting quadratic equation can be solved to give:

$$V_g\geqq\frac{-\alpha+\sqrt{\alpha^2+4}}{2} \tag{12}$$

Also, from (6) and (8):

$$V_g\geqq\frac{8\pi\tilde{b}}{m} \tag{13}$$

Constraint (13), which is derived from constraint (8), appears to be more stringent than constraint (12).

The normalized length of the helical conductor is then given by:

$$\tilde{L}_w=2\pi\sqrt{(N\tilde{b})^2+\tilde{a}^2}=2\pi\tilde{b}\sqrt{N^2+\left(\frac{\tilde{a}}{\tilde{b}}\right)^2} \tag{14}$$

The wire length will be minimized when a=b and for the minimum number of turns, N. When a=b, then from (6)

$$\tilde{b}=\frac{mV_g}{8\pi} \tag{15}$$

and thus $$\tilde{L}_w=\frac{mV_g}{4}\sqrt{N^2+1}>\frac{mV_gN}{4} \tag{16}$$

For a four segment antenna, m=4 and $$L_w > V_g N \tag{17}$$

Substituting equation (15) into equation (10) gives $$V_g N = \left( \frac{\pi^3}{10\sqrt{m}} (1 - V_g^2) \right)^{0.4} \tag{18}$$

For minimum wire length, N=minimum=4, so for a four segment antenna, $$V_g N = 1.151 < L_w \tag{19}$$

In general, the wire length will be smallest for small velocity factors, so equation (18) may be approximated as $$V_g N \approx \left( \frac{\pi^3}{10\sqrt{m}} \right)^{0.4} \tag{20}$$

which when substituted into equation (16) gives $$L_w > m^{.8} \left( \frac{\pi^3}{320} \right)^{0.4} = 0.393\, m^{.8} \tag{21}$$

Thus for all but two segment antennas, the equations of Kandoian and Sichak predict that the total wire length per conductor will be greater than the free space wavelength.

From these equations, one can construct a toroid that effectively has the transmission characteristics of a half wave antenna linear antenna. Experience with a number of contrawound toroidal helical antennas constructed according to this invention has shown that the resonant frequency of a given structure differs from that predicted by equations (2), (6) and (7) and in particular the actual remnant frequency appears to correspond to that predicted by equations (2), (6) and (7) when the number of turns N used in the calculations is larger by a factor of two to three than the actual number of turns for one of the two conductors. In some cases, the actual operating frequency appears to be best correlated with the length of wire. For a given length of toroidal helical conductor $L_w(a,b,N)$, this length will be equal to the free space wavelength of an electromagnetic wave whose frequency is given by:

$$f_w(a, b, N) = \frac{c}{L_w(a, b, N)} \tag{22}$$

In some cases, the measured resonant frequency was best predicted by either $0.75*f_w(a,b,N)$ or $f_w(a,b,2N)$. For example, at a frequency of 106 Mhz a linear half wave antenna would be 55.7" long assuming a velocity factor of 1.0 whereas a toroid design embracing the invention would have the following dimensions.

a=2,738"

b=0.563"

N=16 turns #16 wire m=4 segments

For this embodiment of the toroidal design, equations (2), (6) and (7) predict a remnant frequency of 311.5 MHz and Vg=0.454 for N=16 and 166.7 MHz for N=32. At the measured operating frequency, Vg=0.154 and for equation (4) to hold, the effective value of N must be 51 turns, which is a factor of 3.2 larger than the actual value for each conductor. In this case, $f_w(a,b,2N)$=103.2 MHz.

Figure 13:
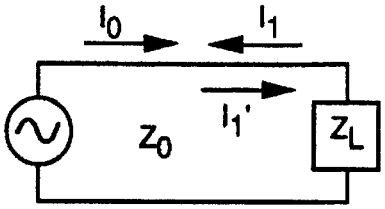
FIG. 13 PRIOR ART
FIG. 13 is an equivalent circuit for a terminated transmission line.

In a variation on the invention shown in FIG. 5, the connections at the two ports a and c to the input signal are broken, as are the conductors at the corresponding nodes. The remaining four open ports a11–a21, a12–a22, c11–c21 and c21–c22 are then terminated with a reactance Z whose impedance is matched to the intrinsic impedance of the transmission line segments formed by the contrawound toroidal helical conductor pairs. The signal reflections from these terminal reactances act (see FIG. 13) to reflect a signal which is in phase quadrature to the incident signals, such than the current distributions on the toroidal helical conductor are similar to those of the embodiment of FIG. 1, thus providing the same radiation pattern but with fewer feed connections between the signal terminals and the signal ports which simplifies the adjustment and tuning of the antenna structure.

Figure 14:
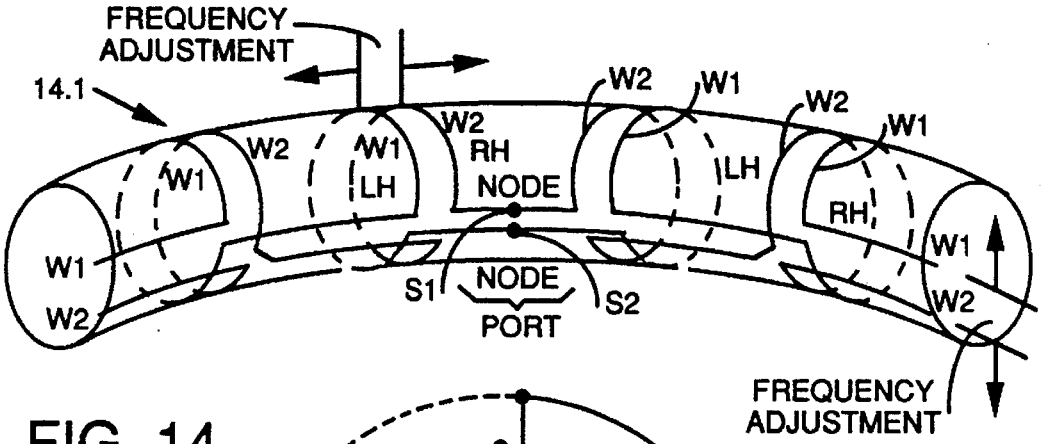
FIG. 14 is an enlarged view of poloidal windings on a toroid according to the present invention for tuning capability, improved electric field cancellation and simplified construction.
Figure 15:
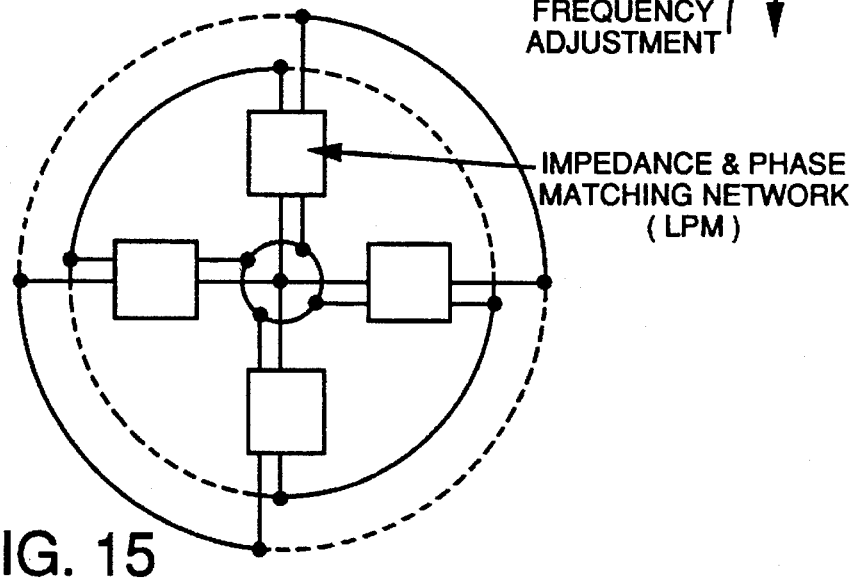
FIG. 15 is a simplified block diagram of a four quadrant version of an antenna embodying the present invention with impedance and phase matching elements.
Figure 16:
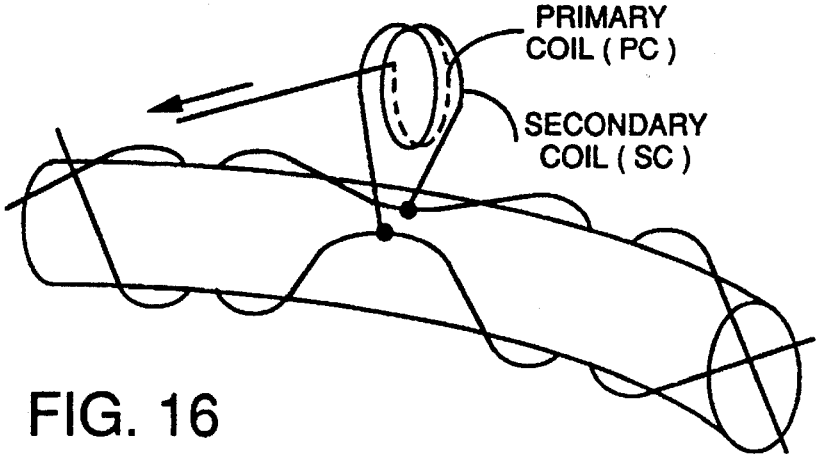
FIG. 16 is an enlargement of the windings of an antenna embodying the invention with primary and secondary impedance matching coils connecting the windings.

The toroidal contrawound conductors may be arranged in other than a helical fashion and still satisfy the spirit of this invention. FIG. 14 shows one such alternate arrangement (a "poloidal-peripheral winding pattern"), whereby the helix formed by each of the two insulated conductors W1. W2 is decomposed into a series of interconnected poloidal loops 14.1. The interconnections form circular arcs relative to the major axis. The two separate conductors are everywhere parallel, enabling this arrangement to provide a more exact cancellation of the toroidal electric current components and more precisely directing the magnetic current components created by the poloidal loops. This embodiment is characterized by a greater interconductor capacitance which acts to lower the resonant frequency of the structure as experimentally verified. The resonant frequency of this embodiment may be adjusted by adjusting the spacing between the parallel conductors W1 and W2, by adjusting the relative angle of the two contrawound conductors with respect to each other and with respect to either the major or minor axis of the torus. The signals at each of the signal ports S1, S2 should be balanced with respect to one another (i.e. equal magnitude with uniform 180° phase difference) magnitude and phase in order to carry out the invention in the best mode. The signal feed transmission line segments should also be matched at both ends, i.e. at the signal terminal common junction and at each of the individual signal ports on the contrawound toroidal helical structure. Imperfections in the contrawound windings, in the shape of the form upon which they are wound, or in other factors may cause variations in impedance at the signal ports. Such variations may require compensation such as in the form illustrated in FIG. 15 so that the currents entering the antenna structure are of balanced magnitude and phase so as to enable the most complete cancellation of the toroidal electric current components as described below. In the simplest form, if the impedance at the signal terminals is $Z_0$, typically 50 Ohms, and the signal impedance at the signal ports were a value of $Z_1$–m*$Z_0$, then the invention would be carried out with m feed lines each of equal length and of impedance $Z_1$ such that the parallel combination of these impedances at the signal terminal was a value of $Z_0$. If the impedance at the signal terminals were a resistive value $Z_1$ different from above, the invention could be carried out with quarter wave transformer feed lines, each one quarter wavelength long, and having an intrinsic impedance of $Z_f=Z_0Z_1$. In general, any impedances could be matched with double stub tuners constructed from transmission line elements. The feed lines from the signal terminal could be inductively coupled to the signal ports as shown in FIG. 16. In addition to enabling the impedance of the signal ports to be matched to the feed line, this technique also acts as a balun to convert an unbalanced signal at the feed terminal to a balanced signal at the signal ports on the contrawound toroidal helical structure. With this inductive coupling approach, the coupling coefficient between the signal feed and the antenna structure may be adjusted so as to enable the antenna structure to resonate freely. Other means of impedance, phase, and amplitude matching and balancing familiar to those skilled in the art are also possible without departing from the spirit of this invention.

Figure 17:
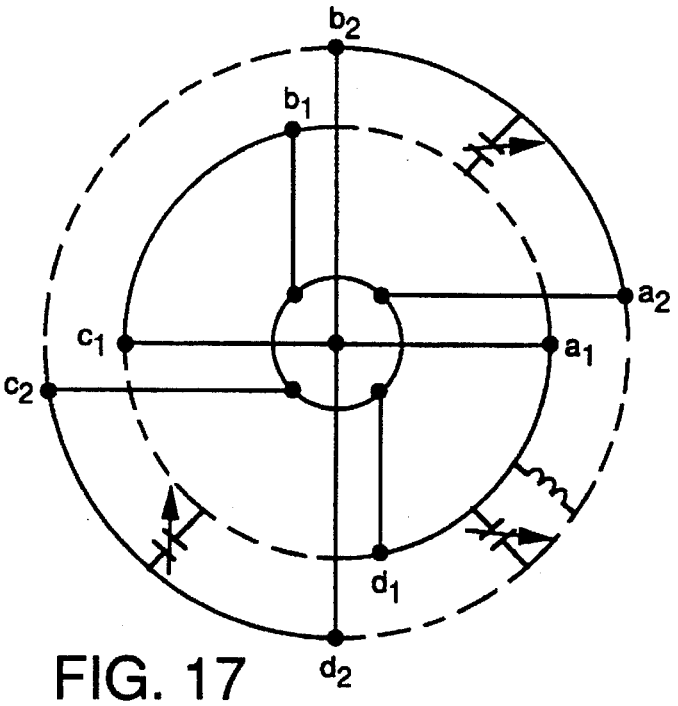
FIG. 17 is an equivalent circuit for an antenna embodying the invention illustrating a means of tuning.
Figure 18:
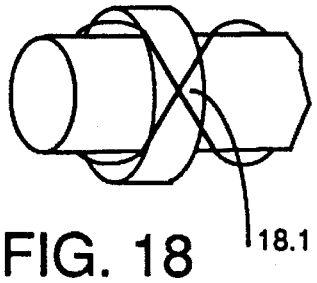
FIGS. 18 and 19 are schematics of a portion of a toroidal antenna using dosed metal foil tuning elements around the toroid for purposes of tuning as in FIG. 17.
Figure 19:
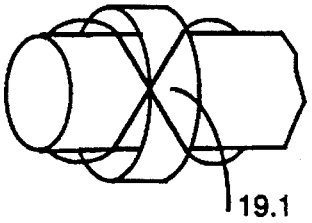
Figure 20:
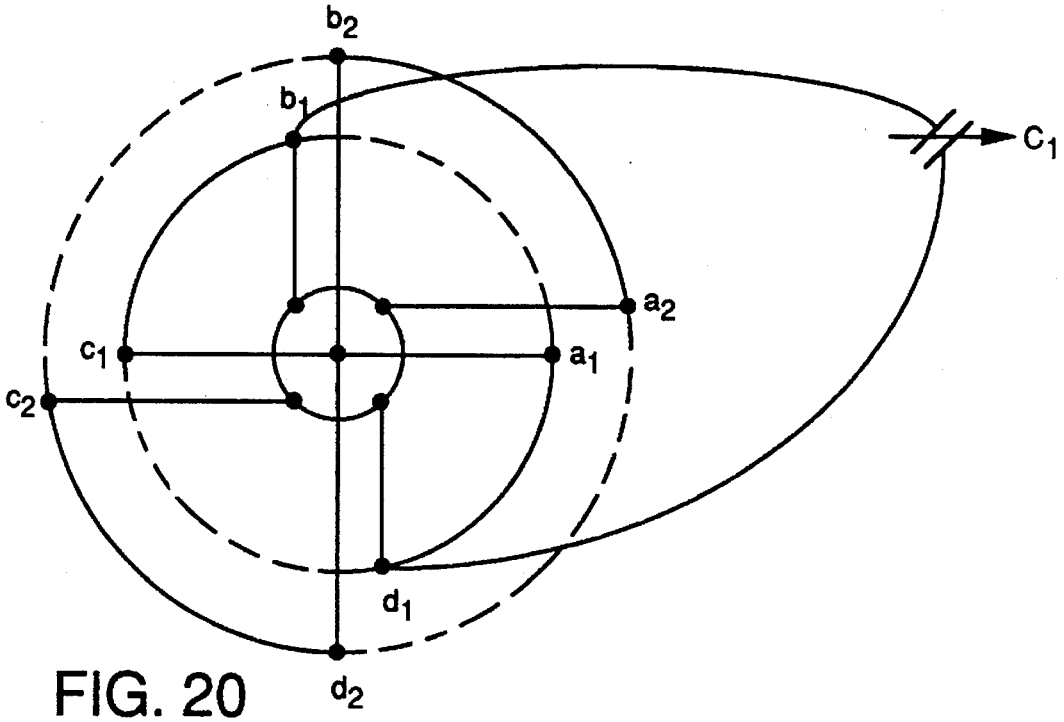
FIG. 20 is a schematic showing an antenna embodying the present invention using a tuning capacitor between opposed nodes.
Figure 21:
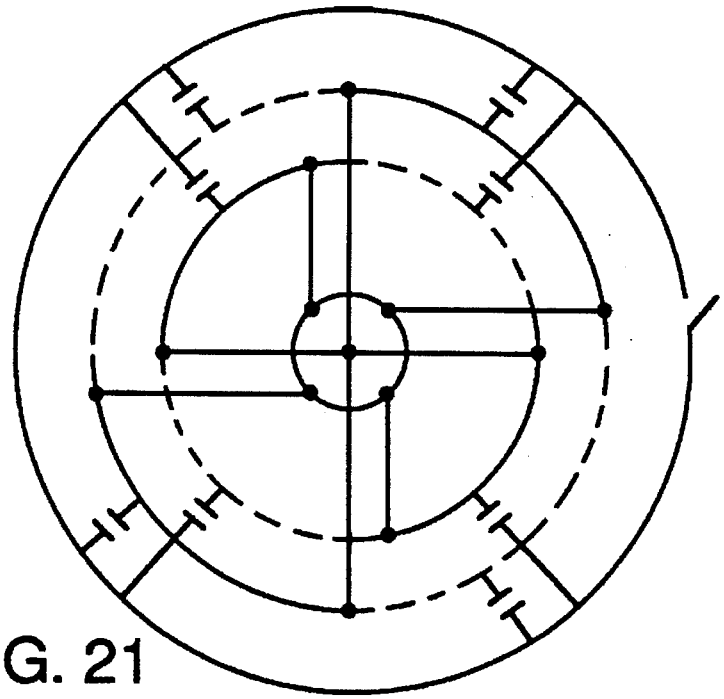
FIG. 21 is an equivalent circuit of an alternate tuning method for of a quadrant antenna embodying the present invention.
Figure 22:
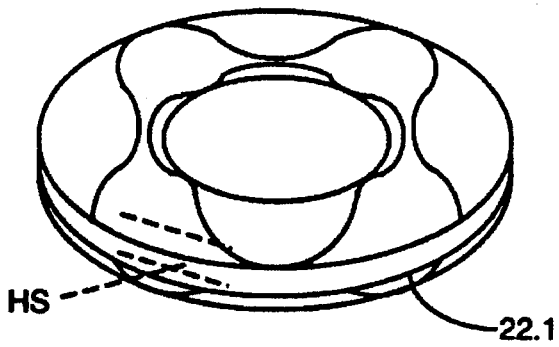
FIG. 22 shows an antenna according to the present invention with a conductive foil wrapper on the toroid for purposes of tuning as in FIG. 21.
Figure 23:
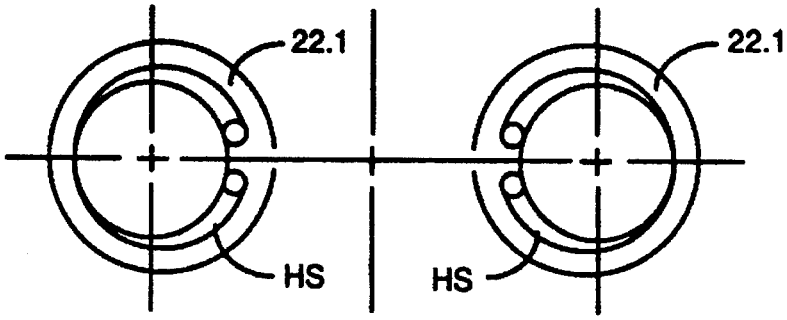
FIG. 23 is a section along line 23—23 in FIG. 24.
Figure 25:
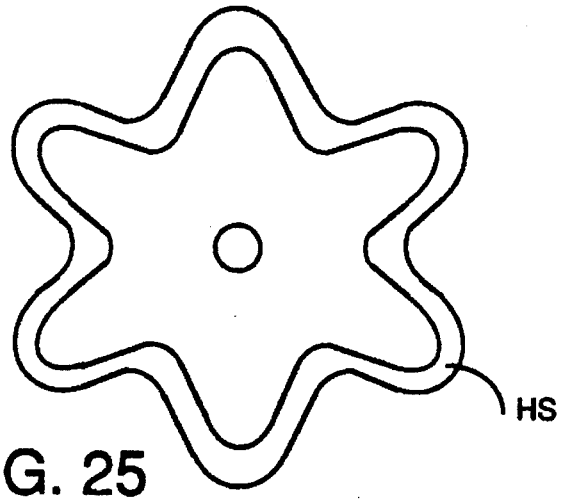
FIG. 25 shows an alternate embodiment of an antenna with "rotational symmetry" embodying the present invention.

The antenna structure may be tuned in a variety of manners. In the best mode, the means of tuning should be uniformly distributed around the structure so as to maintain a uniform azimuthal magnetic ting current. FIG. 17 illustrates the use of poloidal foil structures 18.1, 19.1 (see FIGS. 18 and 19) surrounding the two insulating conductors which act to modify the capacitive coupling between the two helical conductors. The poloidal tuning elements may either be open or closed loops, the latter providing an additional inductive coupling component. FIG. 20 illustrates a means of balancing the signals on the antenna structure by capacitively coupling different nodes, and in particular diametrically opposed nodes on the same conductor. The capacitive coupling, using a variable capacitor C1, may be azimuthally continuous by use of a circular conductive foil or mesh, either continuous or segmented, which is parallel to the surface of the toroidal form and of toroidal extent. The embodiments in FIGS. 23 and 25 result from the extension of the embodiments of either FIGS. 17–21, wherein the entire toroidal helical structure HS is surrounded by a shield 22.1 which is everywhere concentric. Ideally, the toroidal helical structure HS produces strictly toroidal magnetic fields which are parallel to such a shield, so that for a sufficiently thin foil for a given conductivity and operating frequency, the electromagnetic boundary conditions are satisfied enabling propagation of the electromagnetic field outside the structure. A slot (poloidal) 25.1 may be added for tuning as explained herein.

Figure 26:
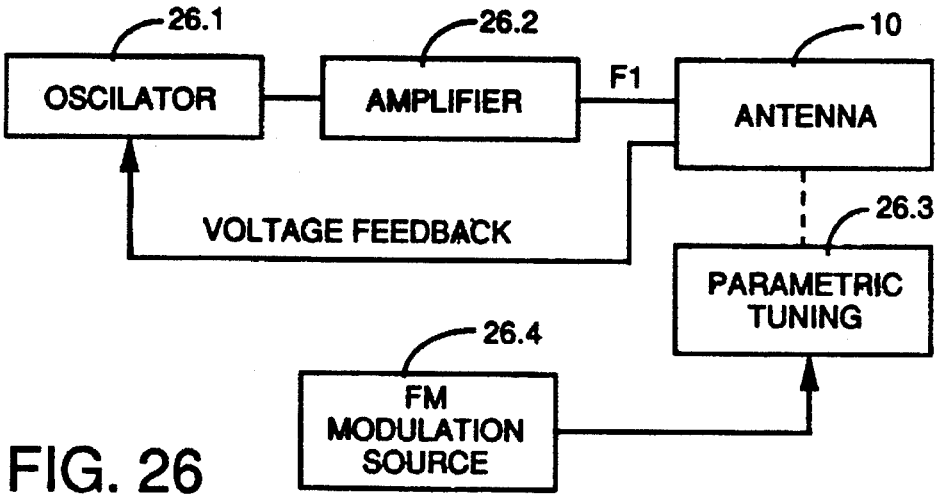
FIG. 26 is a functional block diagram of an FM transmitter using a modulator controlled parametric tuning device on an antenna.

The contrawound toroidal helical antenna structure is a relatively high Q resonator which can serve as a combined tuning element and radiator for an FM transmitter as shown in FIG. 26 having an oscillator amplifier 26.2 to receive a voltage from the antenna 10. Through a parametric tuning element 26.3 controlle by modulation may 26.4, modulation may be accomplished. The transmission frequency F1 is controlled by electronic adjustment of a capacitive or inductive tuning element attached to the antenna structure by either direct modification of reactance or by switching a series fixed reactive elements (discussed previously) so as to control the reactance which is coupled to the structure, and hence adjust the natural frequency of the contrawound toroidal helical structure.

Figure 27:
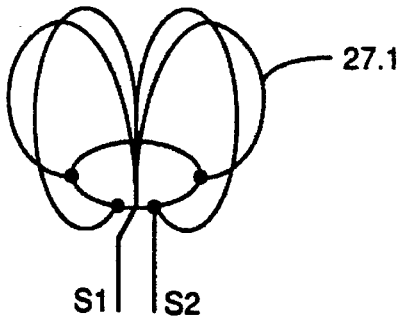
FIG. 27 shows an omnidirectional poloidal loop antenna.
Figure 28:
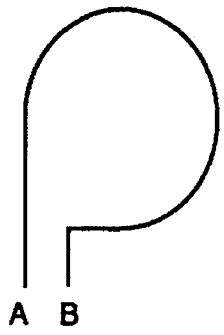
FIG. 28 is a side view of one loop in the antenna shown in FIG. 27.
Figure 29:
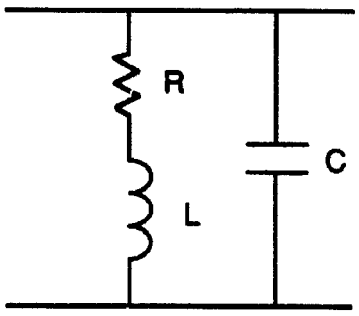
FIG. 29 is an equivalent circuit for the loop antenna.
Figure 30:
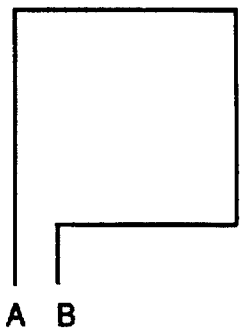
FIG. 30 is a side view of a square loop antenna.
Figure 33:
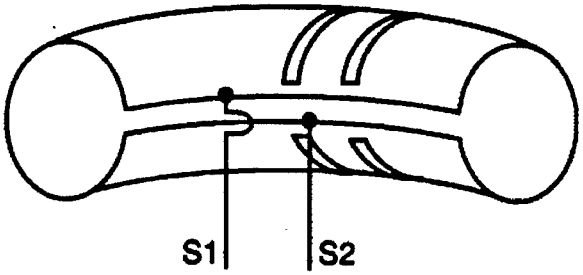
FIG. 33 is a partial view of a toroid with toroid slots for tuning and for emulation of a poloidal loop configuration according to the present invention.

In another variation of the invention shown in FIG. 27, the toroidal helical conductors of the previous embodiments are replaced by a series of N poloidal loops 27.1 uniformly azimuthally spaced about a toroidal form. The center most potions of each loop relative to the major radius of the torus are connected together at the signal terminal S1, while the remaining outer most portions of each loop are connected together at signal terminal S2. The individual loops while identical with one another may be of arbitrary shape, with FIG. 28 illustrating a circular shape, and FIG. 30 illustrating a rectangular shape. The electrical equivalent circuit for this configuration is shown in FIG. 29. The individual loop segments each act as a conventional loop antenna. In the composite structure, the individual loops are fed in parallel so that the resulting magnetic field components created thereby in each loop are in phase and azimuthally directed relative to the toroidal form resulting in an azimuthally uniform ring of magnetic current. By comparison, in the contrawound toroidal helical antenna, the fields from the toroidal components of the contrawound helical conductors are canceled as if these components did not exist, leaving only the contributions from the poloidal components of the conductors. The embodiment of FIG. 27 thus eliminates the toroidal components from the physical structure rather than rely on cancellation of the correspondingly generated electromagnetic fields. Increasing the number of poloidal loops in the embodiment of FIG. 27 results in the embodiments of FIG. 31 and 33 for loops of rectangular and circular profile respectively. The individual loops become continuous conductive surfaces, which may or may not have radial plane slots so as to emulate a multi-loop embodiment. These structures create azimuthal magnetic ring currents which are everywhere parallel to the conductive toroidal surface, and whose corresponding electric fields are everywhere perpendicular to the conductive toroidal surface. Thus the electromagnetic waves created by this structure can propagate through the conductive surface given that the surface is sufficiently thin for the case of a continuous conductor. This device will have the effect of a ring of electric dipoles in moving charge between the top and bottom sides of the structure, i.e. parallel to the direction of the major axis of the toroidal form.

Figure 31:
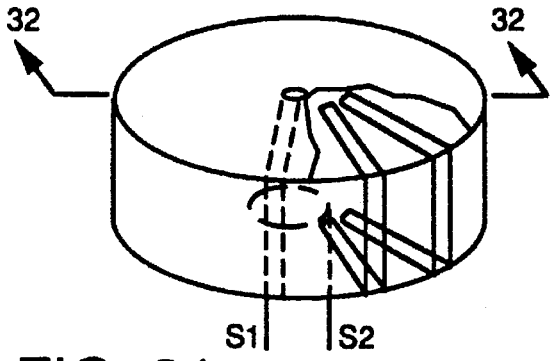
FIG. 31 is a partial cutaway view of cylindrical loop antenna according to the invention.
Figure 32:
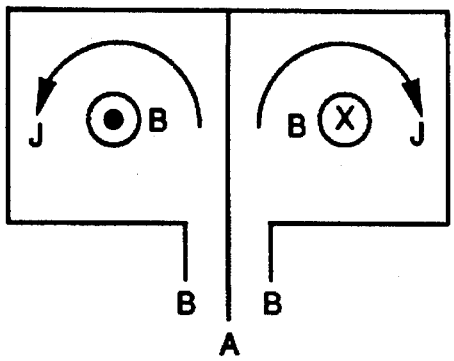
FIG. 32 is a section along 32—32 in FIG. 31 and includes a diagram of the current in the windings.
Figure 34:
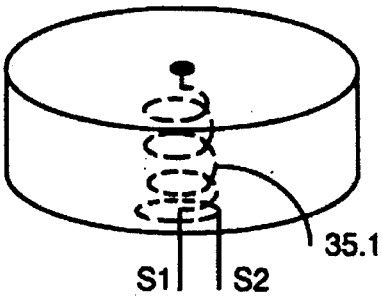
FIG. 34 shows a toroidal antenna with a toroid core tuning circuit.
Figure 35:
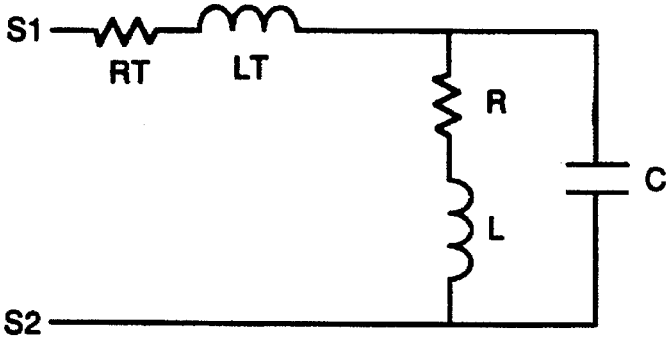
FIG. 35 is an equivalent circuit for the antenna shown in FIG. 34.
Figure 36:
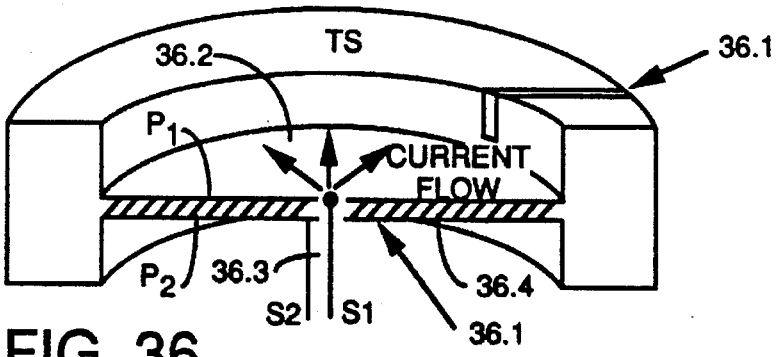
FIG. 36 is a cutaway of a toroidal antenna with a central capacitance tuning arrangement according to the present invention.

The embodiments of FIGS. 27 and 31 share the disadvantage of relatively large size because of the necessity for the loop circumference to be on the order of one half wavelength for resonant operation. However, the loop size may be reduced by adding either series inductance or parallel reactance to the structures of FIGS. 27 and 31. FIG. 34 illustrates the addition of series inductance by forming the central conductor of the embodiment of FIG. 31 into a solenoidal inductor 35.1. FIG. 36 illustrates the addition of parallel capacitance 36.1 to the embodiment of FIG. 31. The parallel capacitor is in the form of a central hub 36.2 for the toroid structure TS which also serves to provide mechanical support for both the toroidal form and for the central electrical connector 36.3 by which the signal at terminals S1 and S2 is fed to the antenna structure. The parallel capacitor and structural hub are formed from two conductive plates P1 and P2, made from copper, aluminum or some other nonferrous conductor, and separated by a medium such as air, Teflon, polyethylene or other low loss dielectric material 36.4. The connector 36.3 with terminals S1 and S2 is conductively attached to and at the center of parallel plates P1 and P2 respectively, which are in turn conductively attached to the respective sides of a toroidal slot on the interior of the conductive toroidal surface TS. The signal current flows radially outward from connector 36.3 through plates P1 and P2 and around the conductive toroidal surface TS. The addition of the capacitance provided by conductive plates P1 and P2 enables the poloidal circumference of the toroidal surface TS to be significantly smaller than would otherwise be required for a similar state of resonance by a loop antenna operating at the same frequency.

Figure 38:
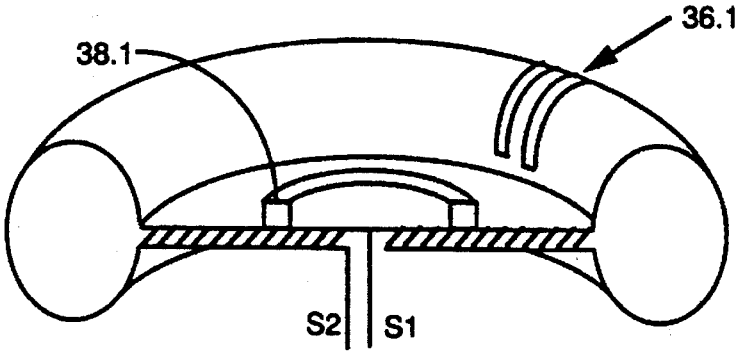
FIG. 38 is an alternate embodiment with variable capacitance tuning.
Figure 37:
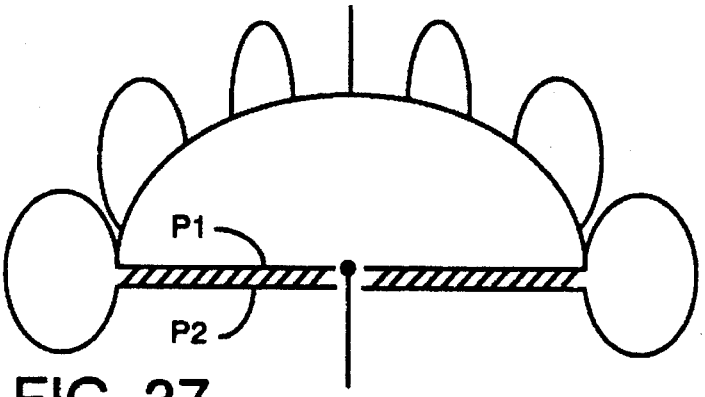
FIG. 37 is a cutaway of an alternate embodiment of the antenna shown in FIG. 36 with poloidal windings.

The capacitive tuning element of FIG. 36 may be combined with the inductive loops of FIG. 27 to form the embodiment of FIG. 37, the design of which can be illustrated by assuming for the equivalent circuit of FIG. 38 that all of the capacitance in the is provided by the parallel plate capacitor, and all of the inductance is provided by the wire loops. The formulas for the capacitance of a parallel plate capacitor and for a wire inductor are given in the reference *Reference Data for Radio Engineers, 7th ed.*, E. C. Jordan ed., 1986, Howard W. Sams, p. 6–13 as:

$$C = 0.225\epsilon_r \left[ (N-1)\frac{A}{t} \right] \tag{23}$$

-continued and $$L_{wire}=\frac{a}{100}\left[7.353\mathrm{Log}_{10}\left(16\frac{a}{d}\right)-6.386\right] \quad (24)$$

where

C=capacitance pfd $L_{wire}$=inductance μH

A=plate area $in^2$ t=plate separation in.

N=number of plates a=mean radius of wire loop in.

d=wire diameter in.

$\epsilon_r$=relative dielectric constant

The resonant frequency of the equivalent parallel circuit, assuming a total of N wires, is then given by:

$$\omega=\frac{1}{\sqrt{L_{total}C}}=\frac{1}{\sqrt{\frac{L_{wire}}{N}C}} \quad (25)$$

$$f=\frac{\omega}{2\pi} \quad (26)$$

For a toroidal form with a minor diameter=2.755 in. and a major inside diameter (diameter of capacitor plates) of 4.046 in. for N=24 loops of 16 gauge wire (d=0.063 in.) with a plate separation of t=0.141 in. gives a calculated resonant frequency of 156.5 MHz.

For the embodiment of FIG. 38, the inductance of a single turn toroidal loops is approximated by:

$$L=\frac{\mu_0 b^2}{2a} \quad (27)$$

where $\mu_0$ is the permeability of free space=400πnH/m, and a and b are the major and minor radius of the toroidal form respectively. The capacitance of the parallel plate capacitor formed as the hub of the torus is given by:

$$C=\epsilon_0\epsilon_r\frac{A}{t}=\epsilon_0\epsilon_r\frac{\pi(a-b)^2}{t} \quad (28)$$

here $\epsilon_0$ is the permitivity of free space=8.854 pfd./m.

Substituting equations (27) and (28) into equations (25) and (26) gives:

$$f=\frac{38.07}{\sqrt{\frac{b^2(a-b)^2\epsilon_r}{at}}}\ \mathrm{MHz} \quad (29)$$

Equation (29) predicts that the toroidal configuration illustrated above except for a continuous conductive surface will have the same resonant frequency of 156.5 MHz if the plate separation is increased to 0.397 in.

The embodiments of FIGS. 36, 37 and 38 can be tuned by adjusting either the entire plate separations, or the separation of a relatively narrow annular slot from the plate as shown in FIG. 38, where this fine tuning means is azimuthally symmetric so as to preserve symmetry in the signals which propagate radially outward from the center of the structure.

Figure 24:
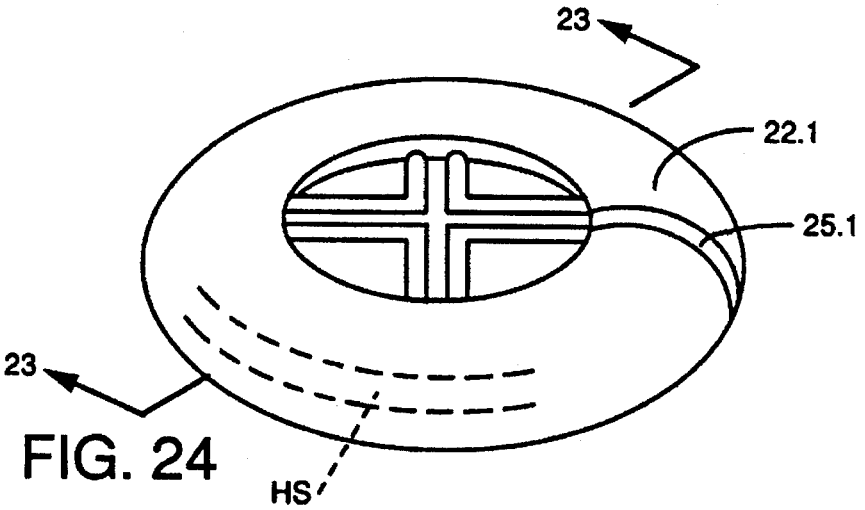
FIG. 24 is a perspective view of a foil covered antenna according to the present invention.
Figure 39:
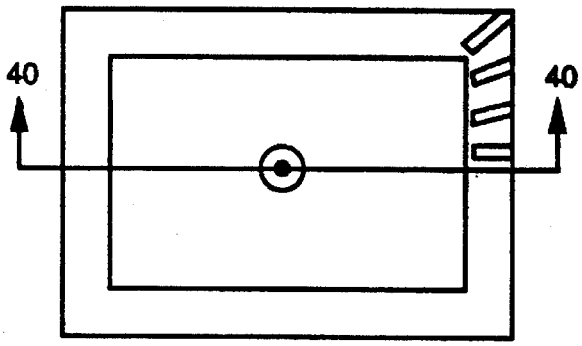
FIG. 39 is a plan view of a square toroidal antenna according to the present invention for augmenting antenna bandwidth and with slots for tuning or for emulation of a poloidal loop configuration.
Figure 40:
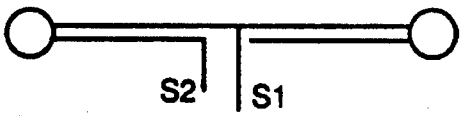
FIG. 40 is a section along 40—40 in FIG. 39.
Figure 41:
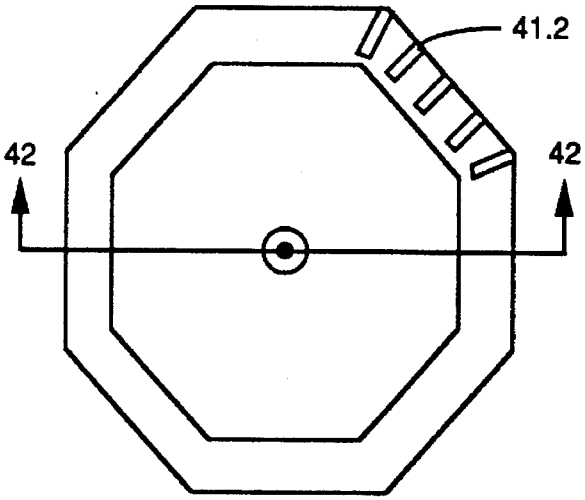
FIG. 41 is a plan view of an alternate embodiment of the antenna shown in FIG. 39 having six sides with slots for tuning or for emulation of a poloidal configuration.
Figure 42:
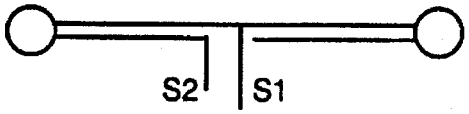
FIG. 42 is a section along 42—42 in FIG. 41.

FIGS. 39 and 41 illustrate means of increasing the bandwidth of this antenna structure. Since the signals propagate outward in a radial direction, the bandwidth is increased by providing different differential resonant circuits in different radial directions. The variation in the geometry is made azimuthally symmetric so as to minimize geometric perturbation to the azimuthal magnetic field. FIGS. 39 and 41 illustrate geometries which are readily formed from commercially available tubing fittings, while FIG. 25 (or FIG. 24) illustrates a geometry with a sinusoidally varying radius which would reduce geometric perturbations to the magnetic field.

Figure 43:
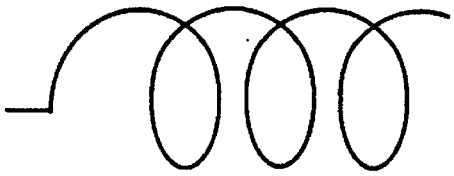
FIG. 43 PRIOR ART
FIG. 43 is a conventional linear helix.
Figure 44:
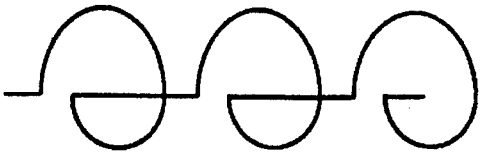
FIG. 44 PRIOR ART
FIG. 44 is an approximate linear helix.
Figure 45:
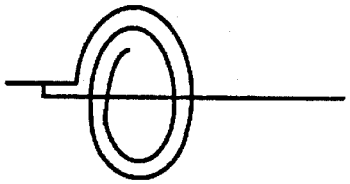
FIG. 45 is a composite equivalent of the configuration shown in FIG. 45 assuming that the magnetic field is uniform or quasi uniform over the length of the helix.
Figure 46:
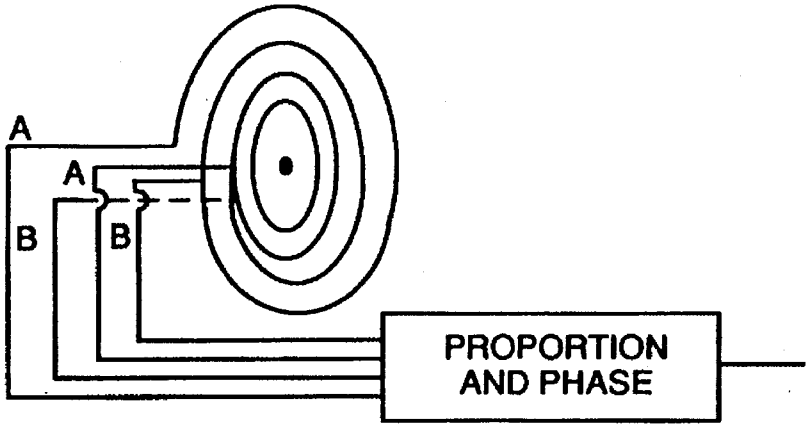
FIG. 46 shows a contrawound toroidal helical antenna with an external loop and a phase shift and proportional control.
Figure 47:
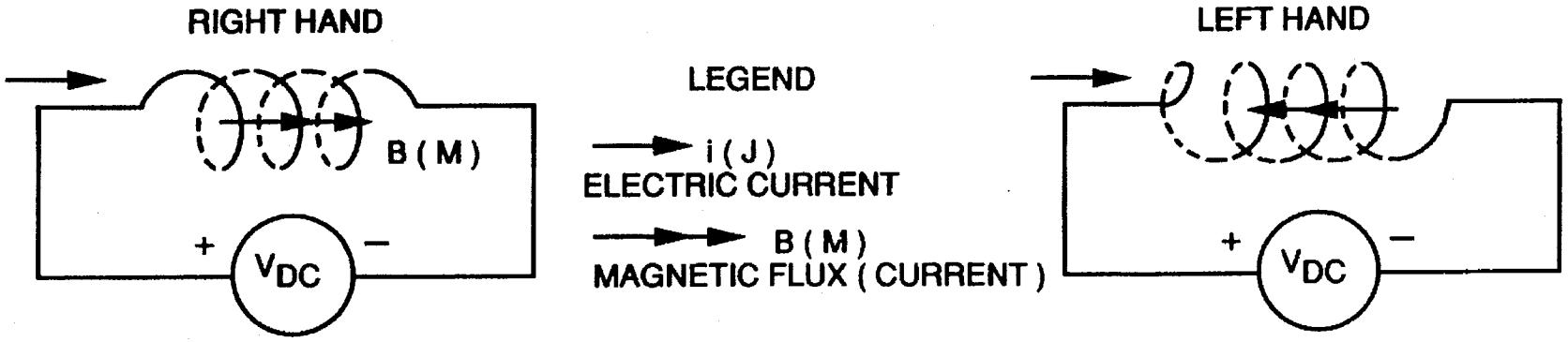
FIG. 47 PRIOR ART
FIG. 47 shows fight hand sense and left hand sense equivalent circuits and associated electric and magnetic fields.

The prior art of helical antennas show their application in remote sensing of geotechnical features and for navigation therefrom. For this application, relatively low frequencies are utilized necessitating large structures for good performance. The linear helical antenna is illustrated in FIG. 43. This can be approximated by FIG. 44 where the true helix is decomposed in to a series of single turn loops separated by linear interconnections. If the magnetic field were uniform or quasi-uniform over the length of this structure, then the loop elements could be separated from the composite linear element to form the structure of FIG. 45. This structure can be further compressed in size by then substituting for the linear element either the toroidal helical or the toroidal poloidal antenna structures described herein, as illustrated in FIG. 46. The primary advantage to this configuration is that the overall structure is more compact than the corresponding linear helix which is advantageous for portable applications as in air, land or sea vehicles, or for inconspicuous applications. A second advantage to this configuration, and to that of FIG. 45 is that the magnetic field and electric field signal components are decomposed enabling them to be subsequently processed and recombined in a manner different from that inherent to the linear helix but which can provide additional information.

Figure 48:
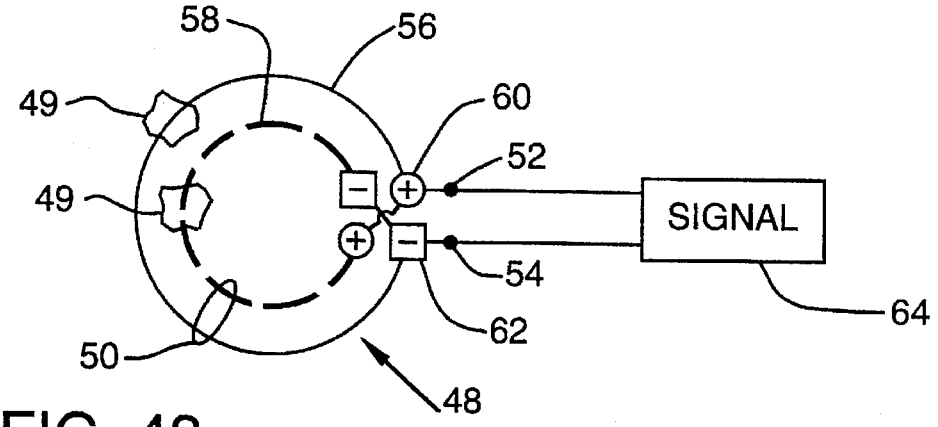
FIG. 48 is a schematic of a series fed antenna.

Referring to FIG. 48, a schematic of an electromagnetic antenna 48 is illustrated. The antenna 48 includes a surface 49, such as the toroid form TF of FIG. 1; an insulated conductor circuit 50; and two signal terminals 52,54, although the invention is applicable to a wide variety of surfaces such as, for example, a multiply connected surface, a generally spherical surface (as shown with FIG. 59), a spherical surface (as shown with FIG. 66), or a hemispherical surface (as shown with FIG. 68).

As employed herein the term "multiply connected surface" shall expressly include, but not be limited to: (a) any toroidal surface such as the toroid form TF of FIG. 1 having its major radius greater than or equal to its minor radius; (b) other surfaces formed by rotating a circle, or a plane closed curve or polygon having a plurality of different radii about an axis lying on its plane, with such other surfaces' major radius being greater than zero, and with such other surfaces' minor radius being less than, equal to or greater than the major radius; and (c) still other surfaces such as surfaces like those of a washer or nut such as a hex nut formed from a generally planar material in order to define, with respect to its plane, an inside circumference greater than zero and an outside circumference greater than the inside circumference, with the outside and inside circumferences being either a plane closed curve and/or a polygon.

The exemplary insulated conductor circuit 50 extends in a conductive path 56 around and over the surface 49 from a node 60 (+) to another node 62 (−). The insulated conductor circuit 50 also extends in another conductive path 58 around and over the surface 49 from the node 62 (−) to the node 60 (+) thereby forming a single endless conductive path around and over the surface 49.

As discussed above in connection with FIG. 1, the conductive paths 56,58 may be contrawound helical conductive paths having the same number of rams, with the helical pitch sense for the conductive path 56 being right hand (RH), as shown by the solid line, and the helical pitch sense for the conductive path 58 being left hand (LH) which is opposite from the RH pitch sense, as shown by the broken lines.

The conductive paths 56,58 may be arranged in other than a helical fashion, such as a generally helical fashion, a partially helical fashion, a poloidal-peripheral pattern, or a spiral fashion, and still satisfy the spirit of this invention. The conductive paths 56,58 may be contrawound "poloidal-peripheral winding patterns" having opposite winding senses, as discussed above in connection with FIG. 14, whereby the helix formed by each of the two insulated conductors W1,W2 is decomposed into a series of interconnected poloidal loops 14.1.

Continuing to refer to FIG. 48, the conductive paths 56,58 reverse sense at the nodes 60,62. The signal terminals 52,54 are respectively electrically connected to the nodes 60,62. The signal terminals 52,54 either supply to or receive from the insulated conductor circuit 50 an outgoing (transmitted) or incoming (received) RF electrical signal 154. For example, in the case of a transmitted signal, the single endless conductive path of the insulated conductor circuit 50 is fed in series from the signal terminals 52,54.

It will be appreciated by those skilled in the art that the conductive paths 56,58 may be formed by a single insulated conductor, such as, for example, a wire or printed circuit conductor, which forms the single endless conductive path including the conductive path 56 from the node 60 to the node 62 and the conductive path 58 from the node 62 back to the node 60. It will be further appreciated by those killed in the art that the conductive paths 56,58 may be formed by plural insulated conductors such as one insulated conductor which forms the conductive path 56 from the node 60 to the node 62, and another insulated conductor which forms the conductive path 58 from the node 62 back to the node 60.

The nominal operating frequency of the signal 64 is tuned to the structure of the antenna 48 in order that the electrical circumference thereof is one-half wavelength in length, and that the current distribution on the structure is sinusoidal in magnitude, which is an approximation. The contrawound conductive paths 56,58, which each have a length of about one-half of a guided wavelength of the nominal operating frequency, may be viewed as elements of a non-uniform transmission line with a balanced feed. The paths 56,58 form a closed loop that, for example, in the case of a toroidal surface such as the toroid form TF of FIG. 1, has been twisted to form a "figure-8" and then folded back on itself to form two concentric windings.

Figure 49:
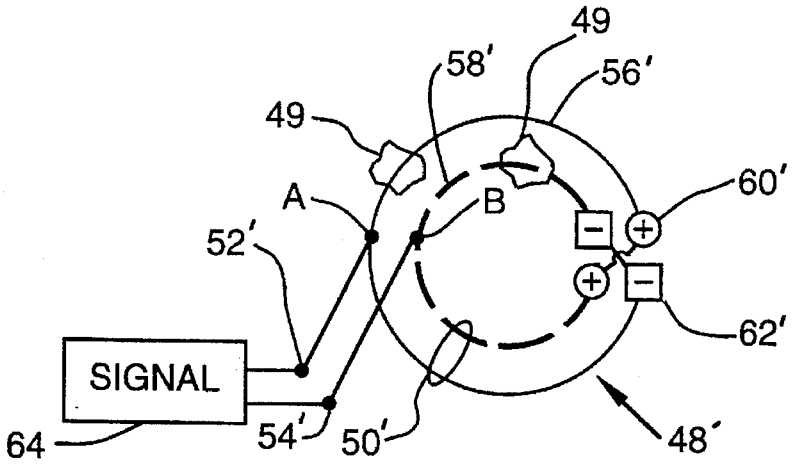
FIG. 49 is a schematic of another series fed antenna.

Referring to FIG. 49, a schematic of another electromagnetic antenna 48' is illustrated. The antenna 48' includes a surface such as the surface 49 of FIG. 48, an insulated conductor circuit 50', and two signal terminals 52',54'. Except as discussed herein, the electromagnetic antenna 48', insulated conductor circuit 50', and signal terminals 52',54' are generally the same as the respective electromagnetic antenna 48, insulated conductor circuit 50, and signal terminals 52,54 of FIG. 48.

The exemplary insulated conductor circuit 50' extends in a conductive path 56' around and over the surface 49 from a node 60' (+) to an intermediate node A and from the intermediate node A to another node 62' (−). The insulated conductor circuit 50' also extends in another conductive path 58' around and over the surface 49 from the node 62' (−) to another intermediate node B and from the intermediate node B to the node 60' (+) thereby forming a single endless conductive path around and over the surface 49.

As discussed above in connection with FIGS. 14 and 48, the conductive paths 56',58' may be contrawound helical conductive paths having the same number of turns or may be arranged in other than a purely helical fashion such as a generally helical fashion, a partially helical fashion, a spiral fashion, or contrawound "poloidal-peripheral winding patterns" having opposite winding senses.

The signal terminals 52',54' either supply to or receive from the insulated conductor circuit 50' an outgoing (transmitted) or incoming (received) RF electrical signal 64. The conductive paths 56',58', which each have a length of about one-half of a guided wavelength of the nominal operating frequency of the signal 64, reverse sense at the nodes 60',62'. The signal terminals 52',54' are respectively electrically connected to the intermediate nodes A,B. Preferably, the nodes 60',62' are diametrically opposed to the intermediate nodes A,B in order that the length of the conductive paths 56',58' from the respective nodes 60',62'to to the respective intermediate nodes A,B is the same as the length of the conductive paths 56',58' from the respective intermediate nodes A,B to the respective nodes 62',60'.

It will be appreciated by those skilled in the art that the conductive paths 56',58' may be formed by a single insulated conductor which forms the single endless conductive path including the conductive path 56' from the node 60' to the intermediate node A and then to the node 62', and the conductive path 58' from the node 62' to the intermediate node B and then to the node 60'. It will be further appreciated by those skilled in the art that each of the conductive paths 56',58' may be formed by one or more insulated conductors such as, for example, one insulated conductor from the node 60' to the intermediate node A and from the intermediate node A to the node 62'; or one insulated conductor from the node 60' to the intermediate node A, and another insulated conductor from the intermediate node A to the node 62'.

Figure 50:
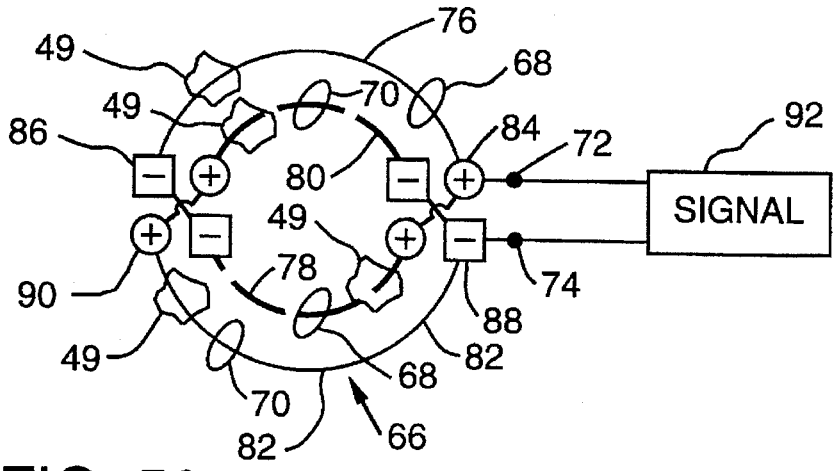
FIG. 50 is a schematic of another antenna having one or two feed ports.

Referring to FIG. 50, a schematic of another electromagnetic antenna 66 is illustrated. The antenna 66 includes a surface such as the surface 49 of FIG. 48, a first insulated conductor circuit 68, a second insulated conductor circuit 70, and two signal terminals 72,74.

The insulated conductor circuit 68 includes a pair of helical conductive paths 76,78, and the insulated conductor circuit 70 similarly includes a pair of helical conductive paths 80,82. The insulated conductor circuit 68 extends in the conductive path 76 around and partially over the surface 49 from a node 84 to a node 86, and also extends in the conductive path 78 around and partially over the surface 49 from the node 86 to the node 84 in order that the conductive paths 76,78 form an endless conductive path around and over the surface 49. The insulated conductor circuit 70 extends in the conductive path 80 around and partially over the surface 49 from a node 88 to a node 90, and also extends in the conductive path 82 around and partially over the surface 49 from the node 90 to the node 88 in order that the conductive paths 80,82 form another endless conductive path around and over the surface 49.

As discussed above in connection with FIGS. 14 and 48, the conductive paths 76,78 and 80,82 may be contrawound helical conductive paths having the same number of rams or may be arranged in other than a purely helical fashion such as a generally helical fashion, a partially helical fashion, a spiral fashion, or contrawound "poloidal-peripheral winding patterns" having opposite winding senses. For example, the pitch sense of the conductive path 76 may be right hand (RH), as shown by the solid line, the pitch sense for the conductive path 78 being left hand (LH) which is opposite from the RH pitch sense, as shown by the broken lines, and the pitch sense for the conductive paths 80 and 82 being LH and RH, respectively. The conductive paths 76,78 reverse sense at the nodes 84 and 86. The conductive paths 80,82 reverse sense at the nodes 88 and 90.

The signal terminals 72,74 either supply to or receive from the insulated conductor circuits 68,70 an outgoing (transmitted) or incoming (received) RF electrical signal 92.

For example, in the case of a transmitted signal, the pair of endless conductive paths of the insulated conductor circuits 68,70 are fed in series from the signal terminals 72,74, although the invention is applicable to parallel feeds at both the nodes 84,88 and the nodes 90,86. Each of the conductive paths 76,78,80,82 have a length of about one-quarter of a guided wavelength of the nominal operating frequency of the signal 92. As shown in FIG. 50, the signal terminal 72 is electrically connected to the node 84 and the signal terminal 74 is electrically connected to the node 88.

It will be appreciated by those skilled in the art that the insulated conductor circuits 68,70 may each be formed by one or more insulated conductors. For example, the insulated conductor circuit 68 may have a single conductor for both of the conductive paths 76,78; a single conductor for each of the conductive paths 76,78; or multiple electrically interconnected conductors for each of the conductive paths 76,78.

Figure 51:
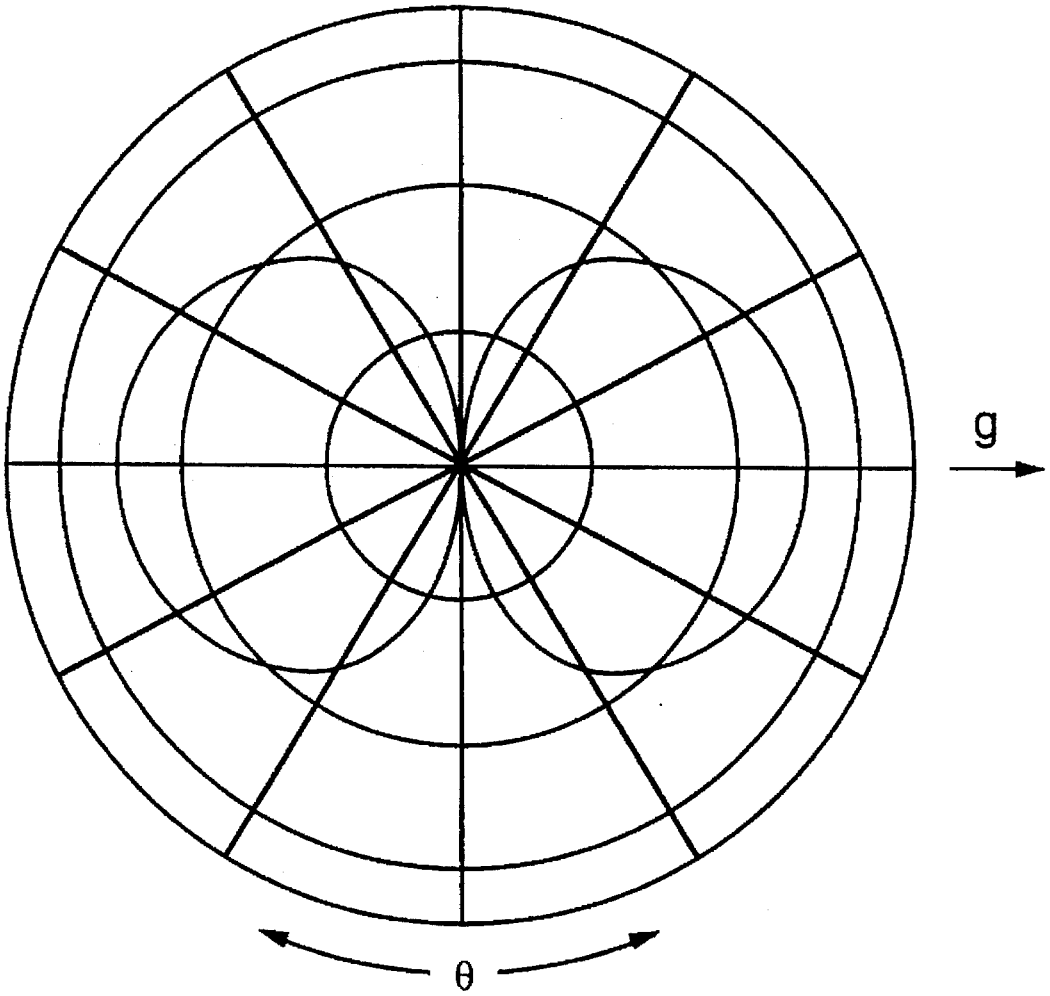
FIG. 51 is a representative elevation radiation pattern for toroidal embodiments of the antennas of FIGS. 48–51.

Referring to FIG. 51, a representative elevation radiation pattern for the electromagnetic antennas 48,48',66 of FIGS. 48,49,50, respectively, is illustrated. These antennas are linearly (e.g., vertically) polarized and have a physically low profile, associated with the minor diameter of the surface 49 of FIGS. 48,49,50, along the direction of polarization. Furthermore, such antennas are generally omnidirectional in directions that are normal to the direction of polarization, with a maximum radiation gain in directions normal to the direction of polarization and a minimum radiation gain in the direction of polarization. The contrawound conductive paths, such as the conductive paths 56,58 of FIG. 48, provide destructive interference which cancels the resulting electrical fields and constructive interference which reinforces the resulting magnetic fields.

Figure 52:
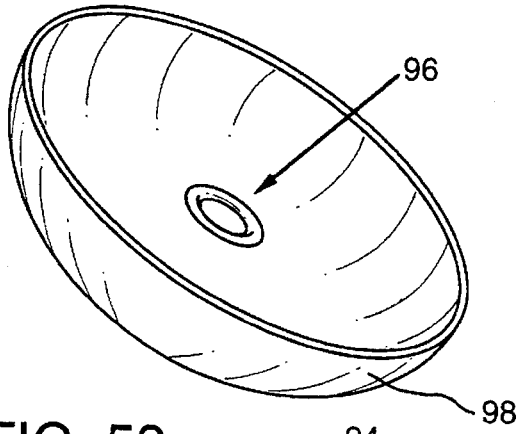
FIG. 52 is an perspective view of a toroidal antenna with a parabolic reflector.
Figure 53:
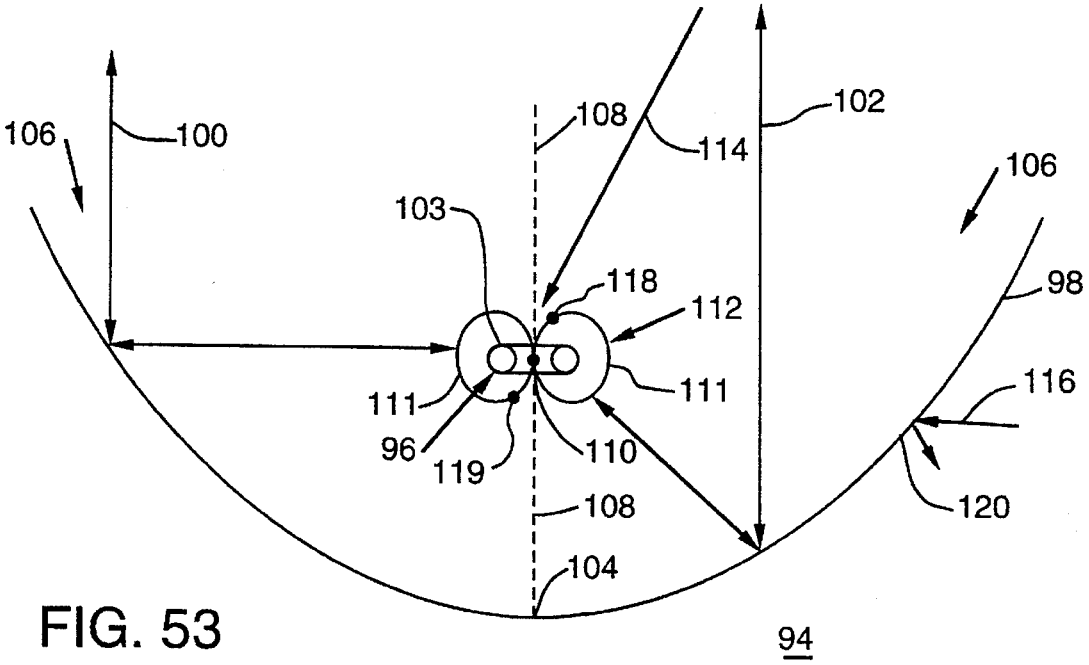
FIG. 53 is a vertical sectional view of the toroidal antenna of FIG. 52.

Referring to FIGS. 52 and 53, an electromagnetic antenna 94 includes a toroidal antenna 96, such as the antennas 10,48,48',66 of respective FIGS. 1,48,49,50; and a parabolic reflector 98, such as a satellite dish reflector, which directs antenna signals 100,102 with respect to the toroidal surface 103 of the antenna 96 for reception or transmission of the antenna signals 100,102, although the invention is more generally applicable to multiply connected surfaces and various types of reflectors. The parabolic reflector 98 has a generally parabolic shape with a vertex 104, an opening 106, and a central axis 108 between the vertex 104 and the opening 106. The parabolic reflector 98 further has a focal point 110 on the central axis 108.

The toroidal surface 103 is located generally between the vertex 104 and the parabolic reflector opening 106. Preferably, the major axis of the toroidal surface 103 is located along the central axis 108 of the parabolic reflector 98, with the center of the toroidal surface 103 being located at the focal point 110 of the parabolic reflector 98.

The electromagnetic antenna 94 provides directionality for the exemplary toroidal antenna 96. The parabolic reflector 98 directs the desired electromagnetic signals 100,102 to the high gain portions 111 of the field pattern 112 of the antenna 96. Other undesired signals 114,116 respectively either encounter the low gain portions 118,119 of the field pattern 112 of the antenna 96 or else are deflected by the parabolic reflector 98, such as at a point 120.

Figure 54:
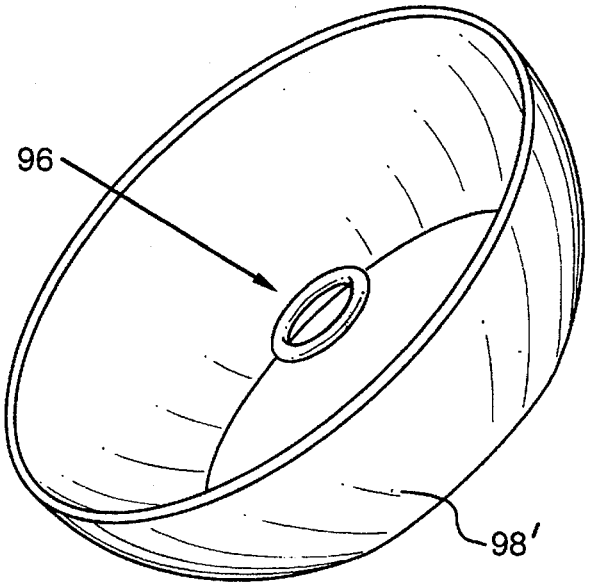
FIG. 54 is an perspective view of a toroidal antenna with an alternative parabolic reflector.
Figure 55:
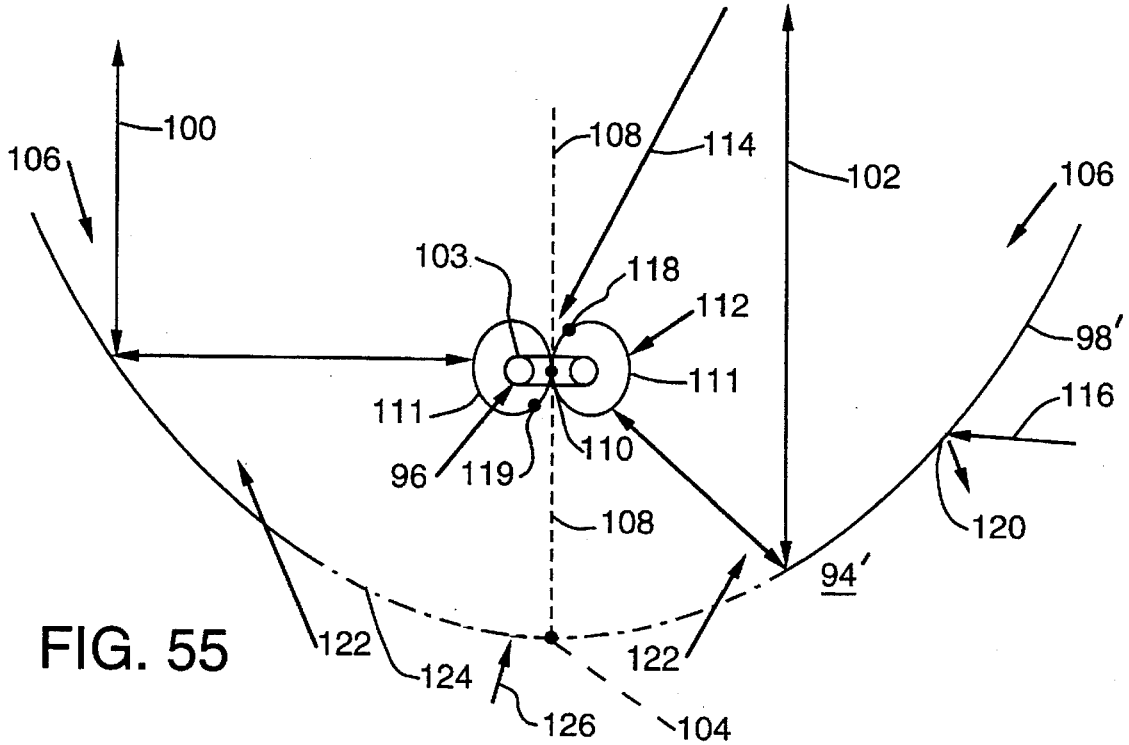
FIG. 55 is a vertical sectional view of the toroidal antenna of FIG. 54.

Referring to FIGS. 54 and 55, an electromagnetic antenna 94'to includes the toroidal antenna 96 of FIGS. 52–53, and a parabolic reflector 98' which directs the antenna signals 100,102 in a similar manner as discussed above in connection with FIG. 53. The parabolic reflector 98' has an opening 122 and a generally parabolic shape 124 (shown in phantom line drawing) which defines a vertex 104 at about the center of the opening 122. The other opening 106 of the parabolic reflector 98' is larger than the opening 122. The toroidal surface 103 is located generally between the openings 106,122 of the parabolic reflector 98'. Except for the opening 122, the parabolic reflector 98' is generally similar to the parabolic reflector 98 of FIGS. 52–53.

The exemplary parabolic reflector 98' in general, and the opening 122 thereof in particular, take advantage of the field pattern 112 of the antenna 96. The low gain portion 119 at the bottom (with respect to FIG. 55) of the antenna 96 does not significantly contribute to transmission or reception of the antenna signals 100,102. Accordingly, the absence of the surface of the parabolic reflector 98' at the opening 122 thereof does not significantly affect the transmission or reception of the antenna signals 100,102. An undesired signal toward the opening 122 bottom of FIG. 55) toward the opening 122 merely encounters the low gain potion 119 of the antenna 96. The absence of the surface of the parabolic reflector 98' at the opening 122 greatly enhances the aerodynamic properties of the electromagnetic antenna 94' for installations in high wind, such as on a motor vehicle or ship, thereby reducing wind drag and, hence, the requisite weight and structural strength of the parabolic reflector 98' needed to resist such wind.

Figure 56:
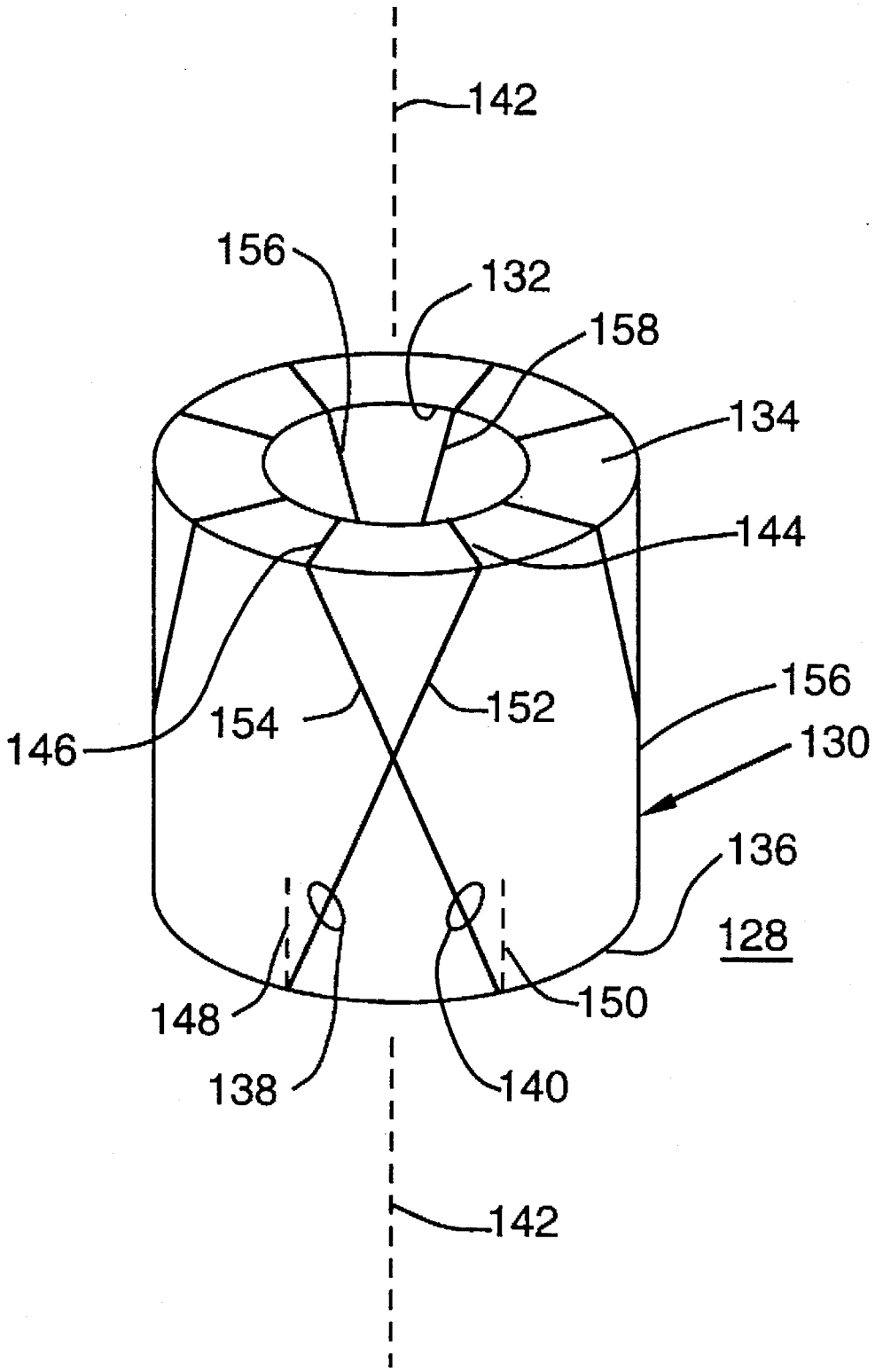
FIG. 56 is an isometric view of a cylindrical antenna having contrawound conductors with partially helical and partially radial conductive paths.

Referring to FIG. 56, an electromagnetic antenna 128 includes a surface, such as the generally cylindrical surface 130 having a bore 132, an upper surface 134 and a lower surface 136, although the invention is applicable to other multiply connected surfaces such as a generally toroidal surface having a generally flat upper surface 134 and/or lower surface 136. The antenna 128 includes a first insulated conductor circuit 138 which extends in a partially helical conductive path around and at least partially over the surface 130 with at least a first helical pitch sense, (e.g., right hand (RH)). The antenna 128 also includes a second insulated conductor circuit 140 which extends in another partially helical conductive path around and at least partially over the surface 130 with at least a second helical pitch sense (e.g., left hand (LH)), in order that the insulated conductor circuits 138,140 are contrawound relative to each other around and at least partially over the surface 130.

The major axis 142 of the electromagnetic antenna 128 is generally perpendicular with respect to the upper surface 134 and the lower surface 136. The insulated conductor circuits 138,140 are generally radial with respect to the major axis 142 as shown with the radial portions 144,146, respectively, on the upper surface 134. The insulated conductor circuits 138,140 are also generally radial with respect to the major axis 142 as shown with the radial portions 148,150 (shown in hidden line drawing), respectively, on the lower surface 136. Otherwise, the insulated conductor circuits 138,140 are generally helically oriented as shown with the generally helical portions 152,154, respectively, on the outer surface 156 of the generally cylindrical surface 130 a well as with the generally helical portions 156,158, respectively, within the bore 132 of the generally cylindrical surface 130. Those skilled in the art will appreciate that the exemplary generally cylindrical surface 130 and the insulated conductor circuits 138,140 with the radial portions 144,146,148,150 and generally helical portions 152,154, 156,158 may be employed with the antennas 10,48,48',66 of respective FIGS. 1,48,49,50.

Figure 57:
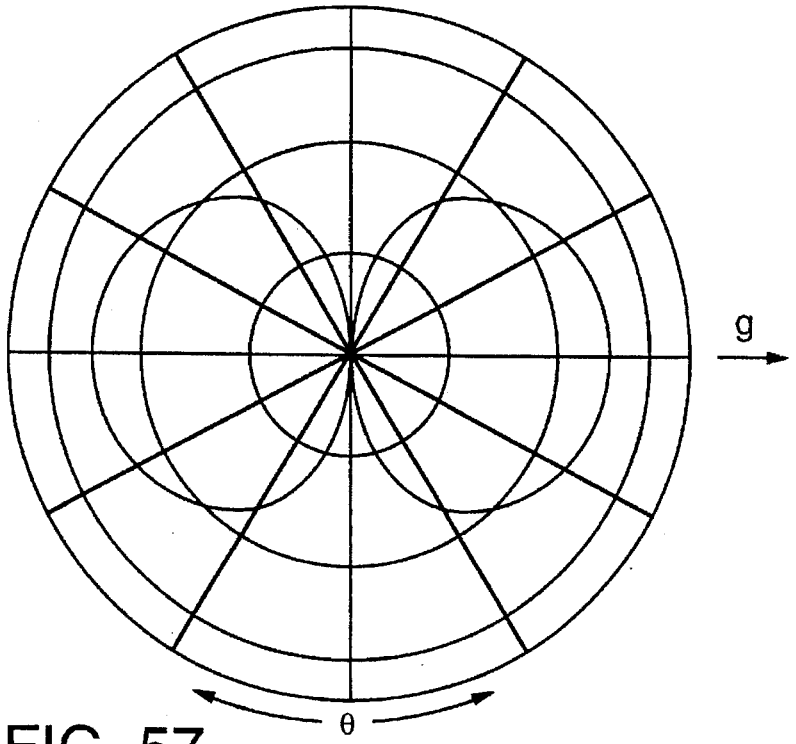
FIG. 57 is a representative elevation radiation pattern for a toroidal antenna having helical conductive paths.
Figure 58:
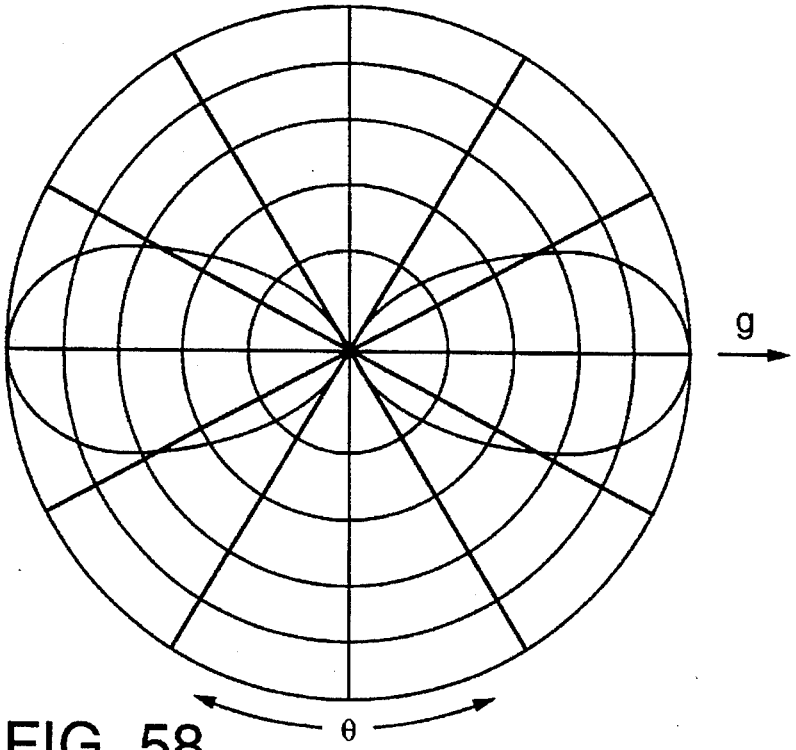
FIG. 58 is a representative elevation radiation pattern for the antenna of FIG. 56.

FIG. 57 illustrates a representative elevation radiation pattern for the antennas 10,48,48',66 of respective FIGS. 1,48,49,50 employing a toroidal surface with helical conductive paths. Also referring to FIG. 58, the exemplary electromagnetic antenna 128 of FIG. 56 radiates or receives more energy radially and, therefore, less energy is radiated or received vertically. Accordingly, in this embodiment, the radiation pattern on the top and bottom of the antenna 128 is further reduced, in comparison with antennas having helical conductive paths, and the radial radiation pattern is enhanced. Furthermore, the exemplary insulated conductor circuits 138,140, which utilize some linear conductor portions 144,146,148,150, reduce the relative size of the major radius of the antenna 128.

Figure 59:
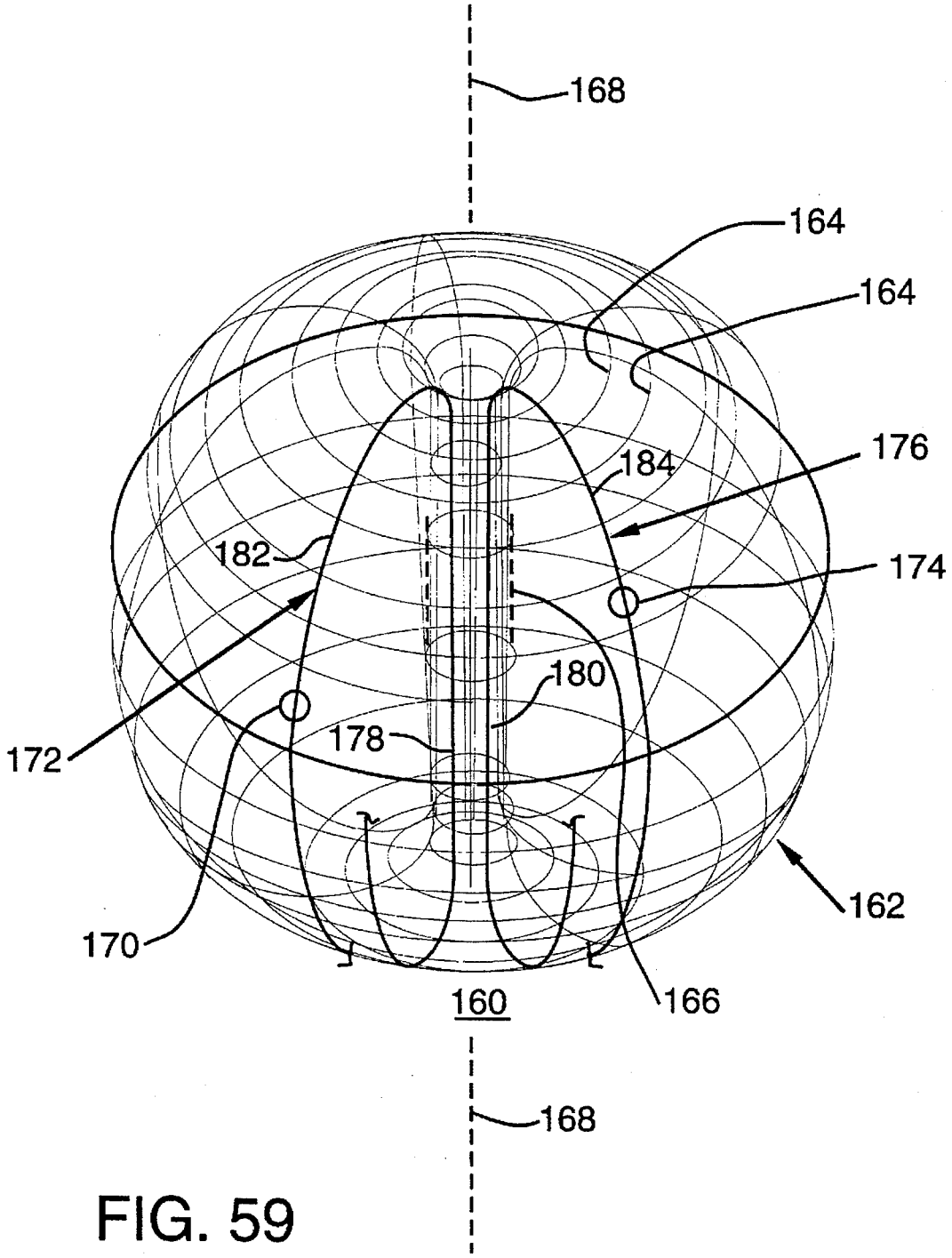
FIG. 59 is an perspective view of a generally spherical toroid form having a generally circular cross section and a central conduit.

Referring to FIG. 59, an electromagnetic antenna 160 includes a generally spherical toroid form surface 162 with a generally circular cross section 164 (as shown by various lines of latitude) and a conduit 166 (shown in hidden line drawing) along the major axis 168 of the surface 162. The antenna 160 includes a first insulated conductor circuit 170 which extends in a first partially helical conductive path 172 around and at least partially over the generally spherical surface 162 with at least a first helical pitch sense (e.g., RH). The antenna 160 also includes a second insulated conductor circuit 174 which extends in a second partially helical conductive path 176 around and at least partially over the generally spherical surface 162 with at least a second helical pitch sense (e.g., LH), in order that the first and second insulated conductor circuits 170,174 are contrawound relative to each other around and at least partially over the generally spherical surface 162. The partially helical conductive paths 172,176 pass through the conduit 166 and are generally parallel to the major axis 168 within the conduit 166 as shown with the generally linear portions 178,180 of the respective paths 172,176. Otherwise, the paths 172,176 have respective generally helical portions 182,184. Those skilled in the art will appreciate that the exemplary generally spherical surface 162 and the insulated conductor circuits 170,174 with the generally linear portions 178,180 and generally helical portions 182,184 may be employed with the antennas 10,48,48',66 of respective FIGS. 1,48,49,50.

Figure 60:
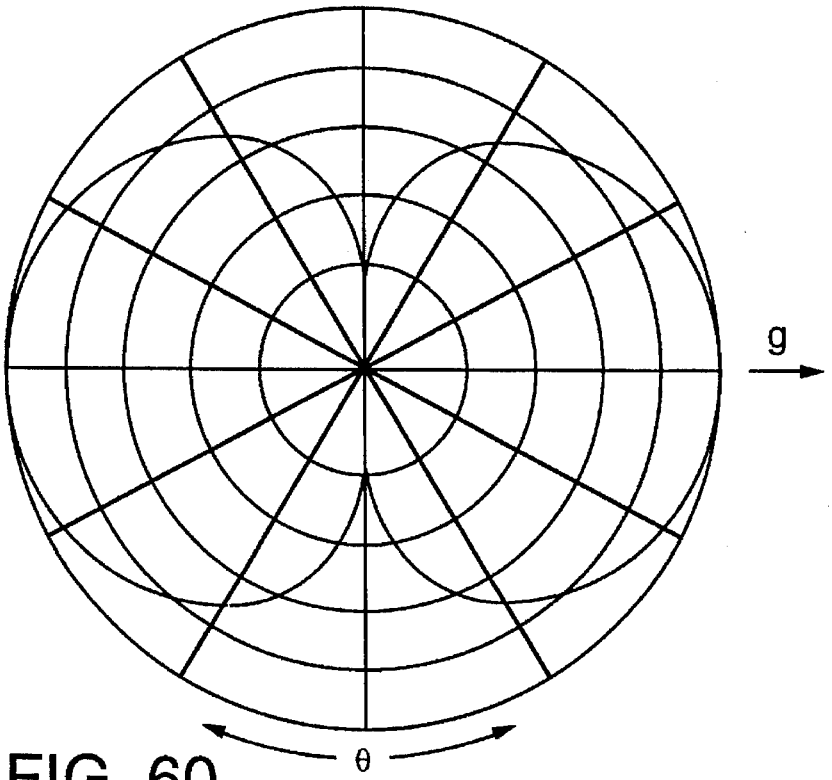
FIG. 60 is a representative elevation radiation pattern for a toroidal antenna having helical conductive paths.
Figure 61:
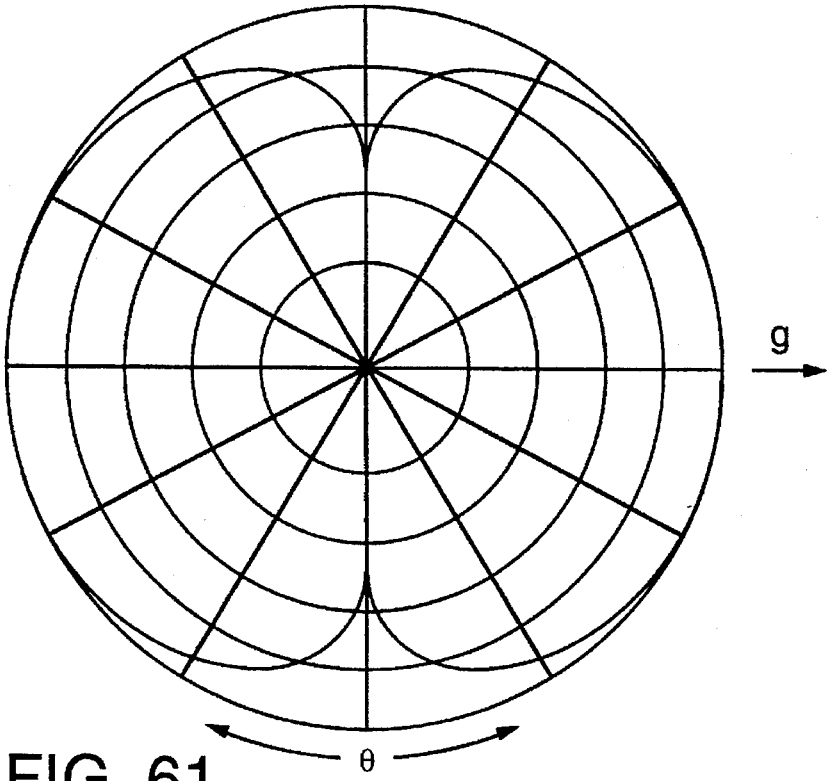
FIG. 61 is a representative elevation radiation pattern for the antenna of FIG. 59.

FIG. 60 illustrates a representative elevation radiation pattern for the antennas 10,48,48',66 of respective FIGS. 1,48,49,50 employing a toroidal surface with helical conductive Paths. Also referring to FIG. 61, the exemplary electromagnetic antenna 160 of FIG. 59 radiates or receives more energy vertically. Therefore, in this embodiment, the radiation pattern on the top and bottom of the antenna 160 is enhanced, in comparison with antennas having helical conductive paths. In this manner, this embodiment produces a somewhat more symmetrical radiation pattern.

Figure 62:
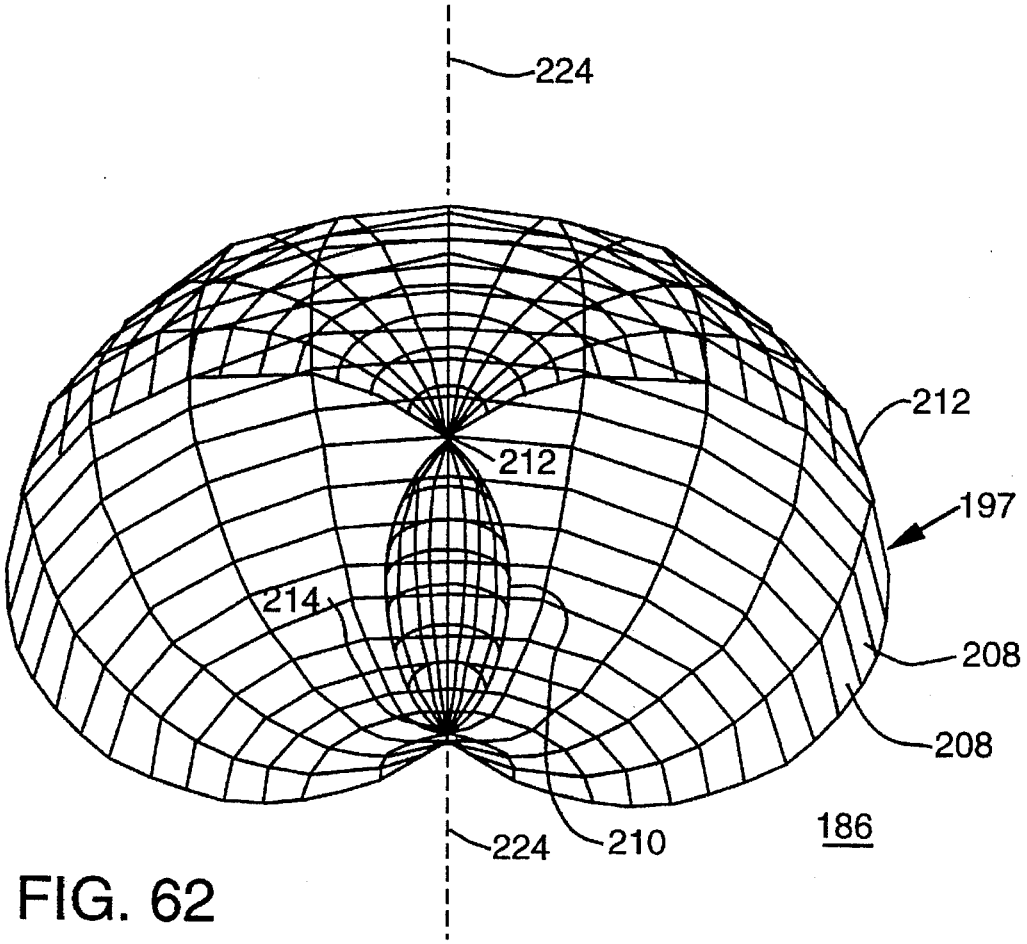
FIG. 62 is a vertical sectional perspective view of a toroid form having a minor radius greater than a major radius.
Figure 63:
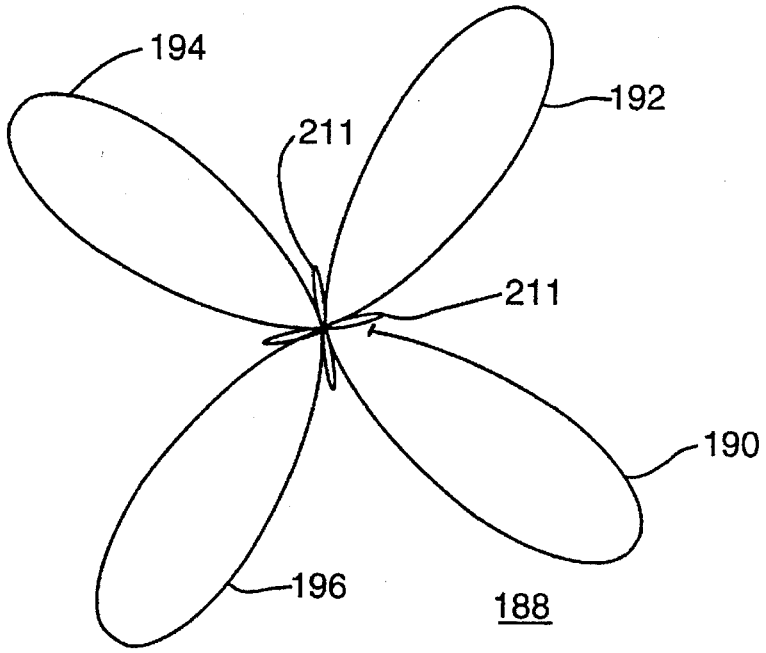
FIG. 63 is a plan view of a conductor with a helical conductive path for the toroid form of FIG. 62.
Figure 64:
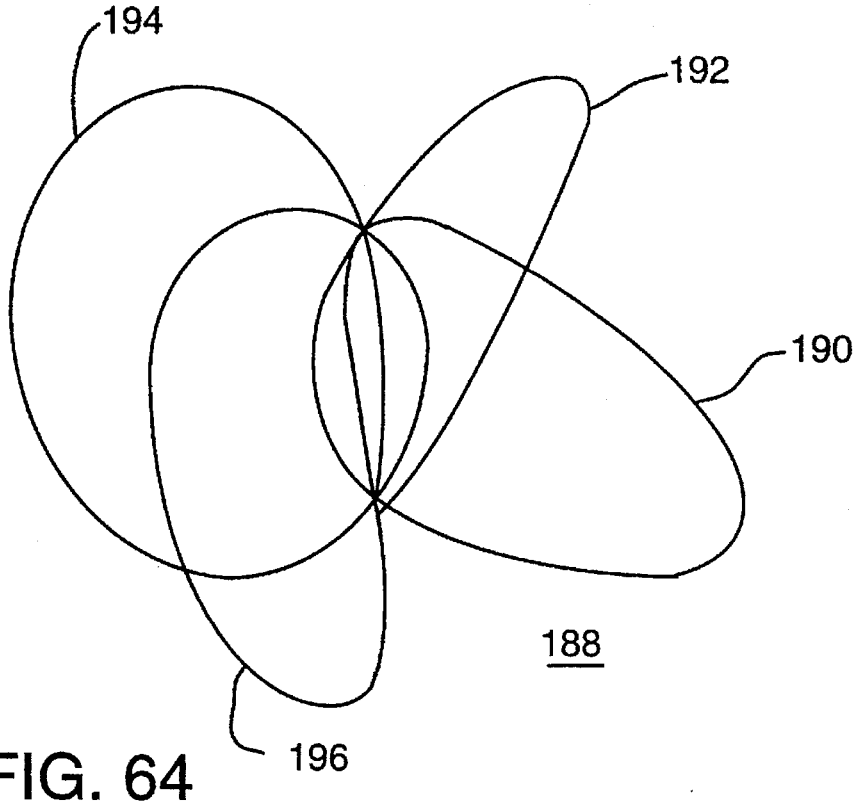
FIG. 64 is an perspective view of the conductor of FIG. 63.
Figure 65:
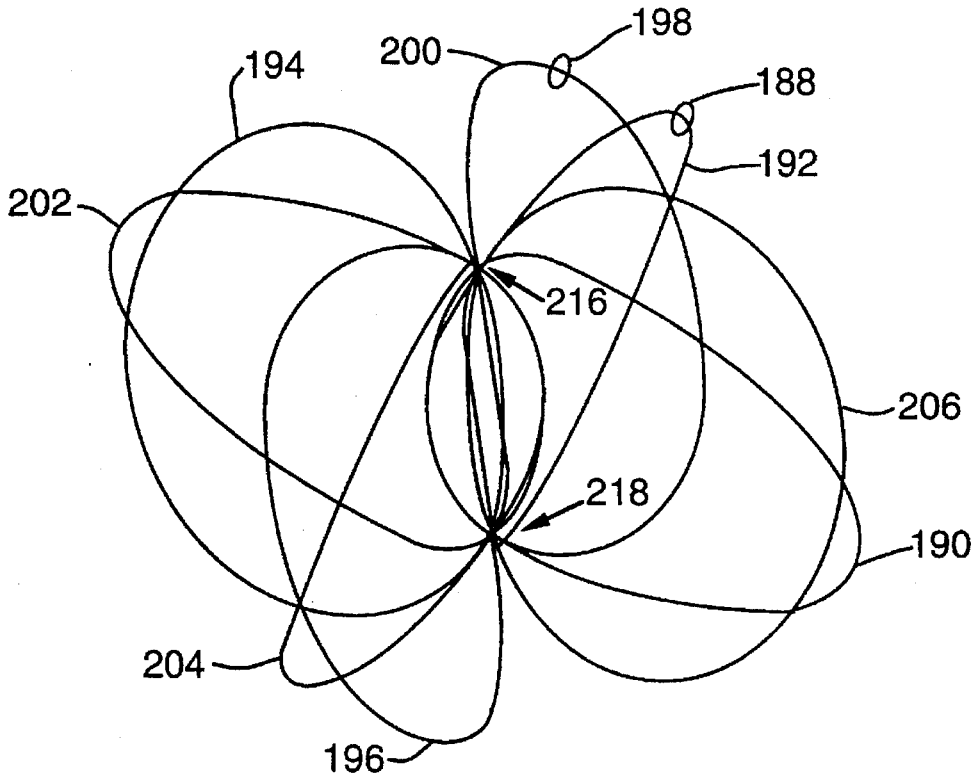
FIG. 65 is an perspective view of contrawound conductors with helical conductive paths for the toroid form of FIG. 62.

FIG. 62 illustrates a vertical sectional perspective view of a toroid form 186 in which the minor radius is greater than the major radius thereof, although the invention is applicable to any multiply connected surface having a major radius which is greater than zero and a minor radius which is greater than the major radius. Also referring to FIGS. 63 and 64, respective plan and perspective views illustrate the path of an insulated conductor circuit 188 having four turns 190,192,194,196, although the invention is applicable to insulated conductor circuits having any number of turns. Employed with the exemplary toroid form 186, the insulated conductor circuit 188 extends in a generally helical conductive path around and at least partially over the surface 197 of the exemplary toroid form 186, in a manner described below, with at least a first helical pitch sense (e.g. RH). Also referring to FIG. 65, another insulated conductor circuit 198 having four turns 200,202,204,206 may also be employed with the exemplary toroid form 186. The second insulated conductor circuit 198 extends in a generally helical conductive path around and at least partially over the surface 197 of the toroid form 186 with at least a second helical pitch sense (e.g. LH), in order that the insulated conductor circuits 188,198 are contrawound relative to each other around and at least partially over the surface 197 of the toroid form 186.

The surface 197 of the toroid form 186 may be implemented, for example, as a mesh screen surface having a plurality of openings 208 therein for routing the insulated conductor circuits 188,198 therethrough. In this exemplary manner, the central portion 210 of the toroid form 186 is accessible for routing the portions 211 (best shown in FIG. 63) of the circuits 188,198 therein, although other implementations are possible such as, for example, assembling the toroid form 186 with a plurality of pie slices which form the central potion 210 and which provide routing channels for the circuits 188,198; or drilling suitable routing holes into a solid toroid form.

Those skilled in the art will appreciate that the exemplary toroid form 186 and the exemplary insulated conductor circuits 188,198 may be employed with the antennas 10,48, 48',66 of respective FIGS. 1,48,49,50. The circuits 188,198 pass through two common points 212,214 in the toroid form 186 at the respective portions 216,218 (shown in FIG. 65) of the circuits 188,198.

Figure 72:
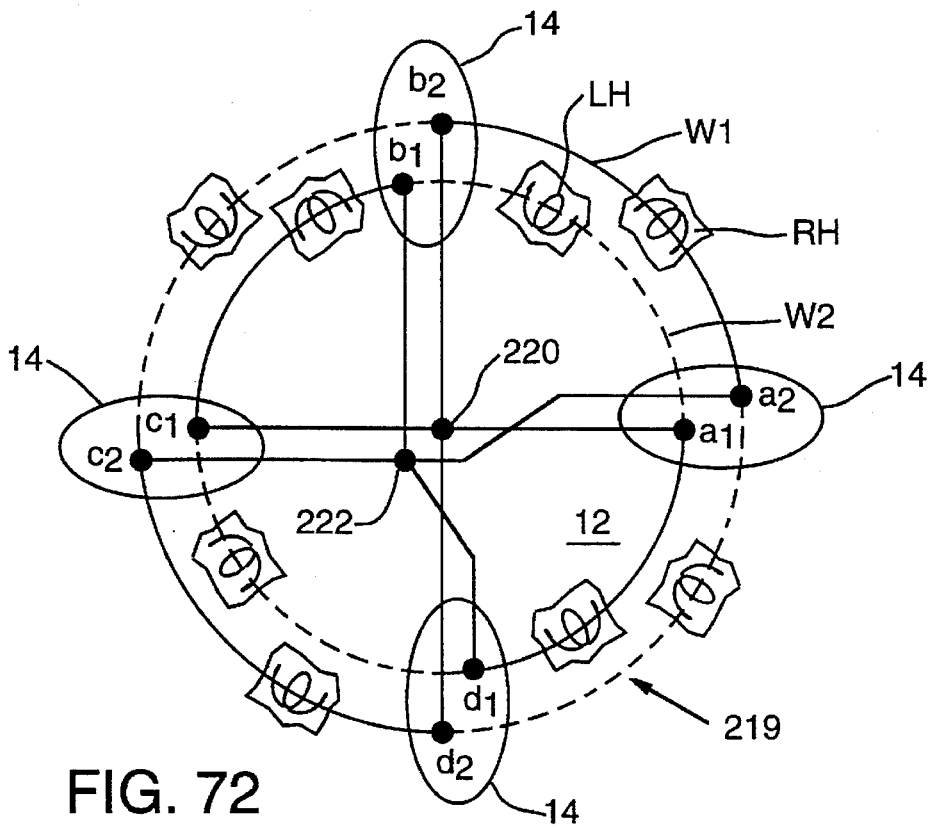
FIG. 72 is a schematic of a four segment helical antenna for use with the toroidal form of FIG. 62.

As schematically shown in FIG. 72, the antenna 219, which is similar to the antenna 10 of FIG. 1, includes nodes a1,b2,c1,d2 which converge (with smaller values of the major radius) at a terminal 220 and the nodes a2,b1,c2,d1 similarly converge at a terminal 222, where the lines between the nodes a1,b2,c1,d2 and a2,b1,c2,d1 are shown for convenience of illustration. In this manner, the antenna 219 has a single port at the terminals 220,222 or, alternatively, may be fed independently at each of the segments 12. In turn, the terminals 220 and 222 are electrically connected to the respective nodes a1,b2,c1,d2 and a2,b1,c2,d1 which converge (with smaller values of the major radius) at substantially common points 212,214 along the major axis 224 of the toroid form 186. The points 212,214 are associated with the respective portions 216,218 (shown in FIG. 65) of the circuits 188,198.

A three dimensional toroidal surface such as the toroid form TF of FIG. 1 may be represented by the following equations:

$$x=a\cos(\theta)+b\cos(\psi)\cos(\theta) \tag{30}$$

$$y=a\sin(\theta)+b\cos(\psi)\sin(\theta) \tag{31}$$

$$z=b\sin(\psi) \tag{32}$$

wherein:

a: major radius b: minor radius $\phi$: poloidal angle (0 to $2\pi$)

$\theta$: azimuthal angle (0 to $2\pi$)

A helix existing on the toroid form TF of FIG. 1 is defined by setting:

$$\psi=N\theta \tag{33}$$

wherein:

N: number of turns in the helix

N>0: right hand (RH) windings

N<0: left hand (LH) windings

The equations defining a helix are:

$$x=a\cos(\theta)+b\cos(N\theta)\cos(\theta) \tag{34}$$

$$y=a\sin(\theta)+b\cos(N\theta)\sin(\theta) \tag{35}$$

$$z=b\sin(N\theta) \tag{36}$$

By taking N to be both positive and negative, Equations 34–36 adequately describe both contrawound windings.

Figure 66:
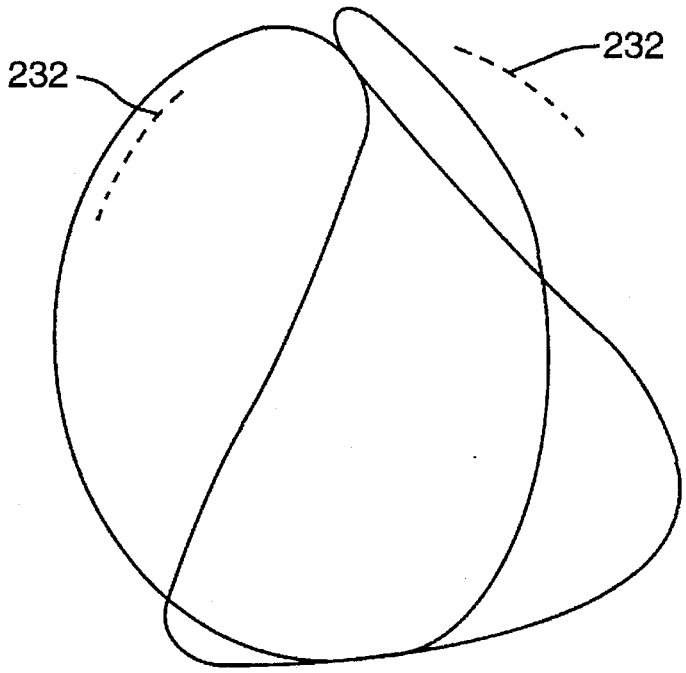
FIG. 66 is an perspective view of a single spherical conductor for a spherical form antenna.
Figure 67:
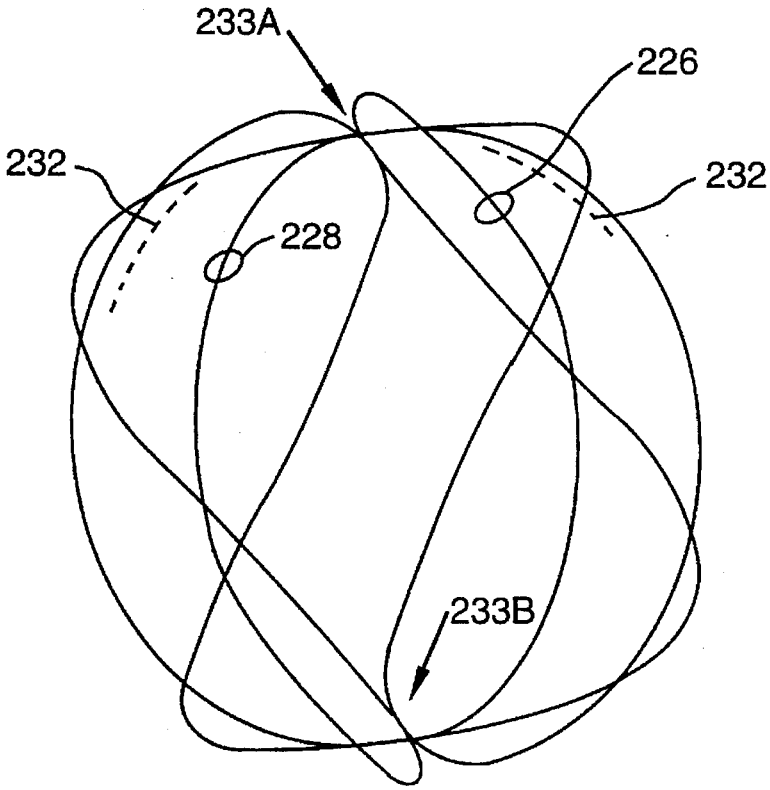
FIG. 67 is an perspective view of contrawound spherical conductors for a spherical form antenna.

Referring to FIGS. 66 and 67, contrawound spherical conductors 226,228 for a spherical form antenna 230 having a spherical surface 232 are illustrated. Although a spherical surface is preferred, the invention is applicable to generally spherical surfaces. The conductor 226 extends in a first conductive path around and at least partially over the spherical surface 232 with at least a first winding sense (e.g., RH). The conductor 228 extends in a second conductive path around and at least partially over the spherical surface 232 with at least a second winding sense (e.g., LH), in order that the conductors 226,228 are contrawound relative to each other around and at least partially over the spherical surface 232.

For the spherical embodiment, the equations describing the contrawound windings are developed by setting the major radius a to zero, as shown in the following equations:

$$x=b\cos(N\theta)\cos(\theta) \tag{37}$$

$$y=b\cos(N\theta)\sin(\theta) \tag{38}$$

$$z=b\sin(N\theta) \tag{39}$$

A sphere provides the benefit of a more spherical radiation pattern, although the invention is applicable to generally spherical embodiments where the major radius is greater than zero. This approaches the radiation pattern of an ideal isotropic radiator or point source which projects energy equally in all directions. By employing the contrawound windings 226,228, the electric fields cancel and leave a magnetic loop current of about zero radius. Those skilled in the art will appreciate that the exemplary spherical surface 232 and the exemplary contrawound windings 226,228 may be employed with the antennas 10,48,48',66 of respective FIGS. 1,48,49,50 where, for example, polar nodes 233A, 233B of FIG. 67 facilitate changes between the winding senses (e.g., LH and RH) where the paths of the contrawound windings 226,228 generally repeatedly intersect thereabout.

Figure 68:
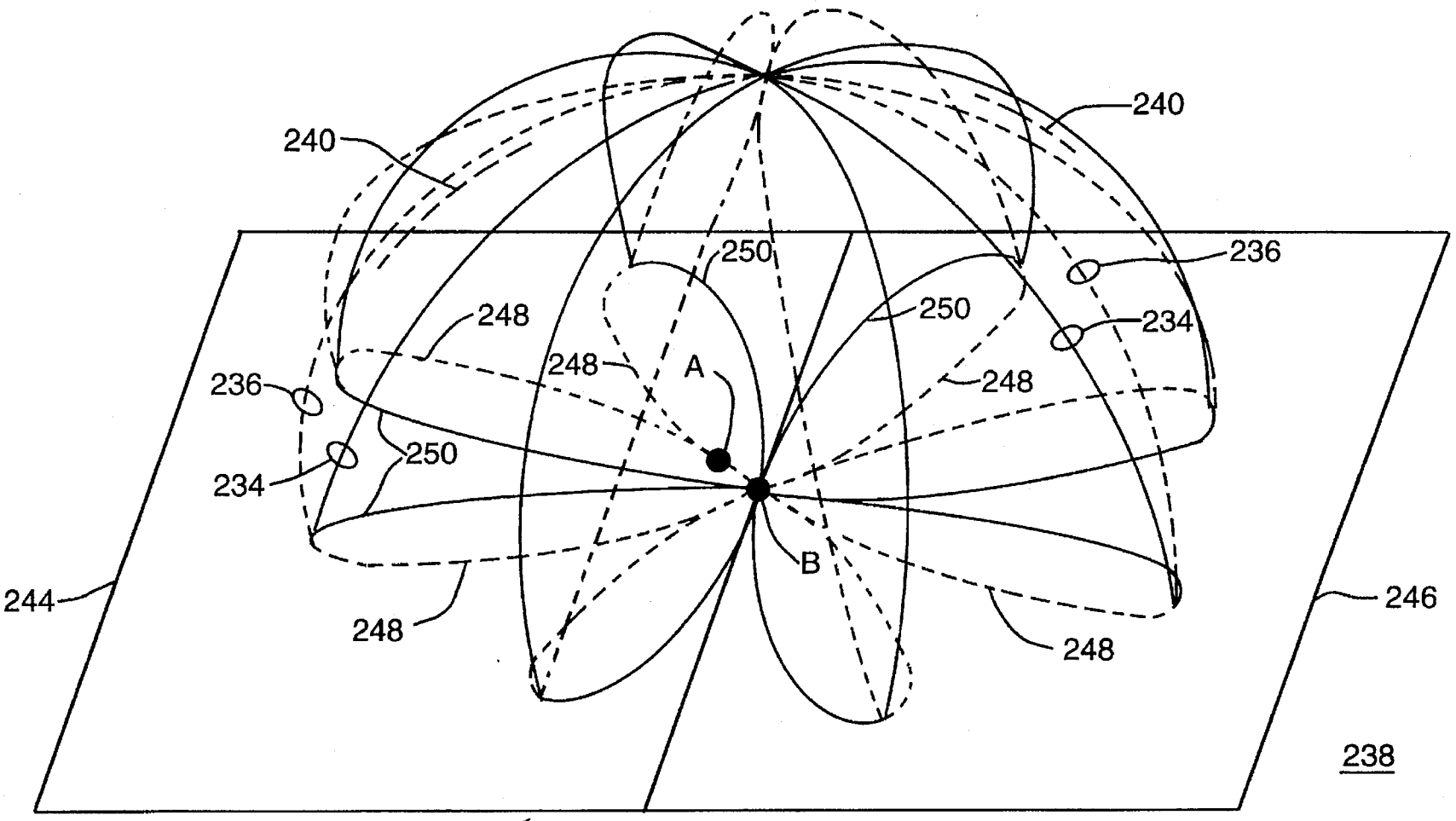
FIG. 68 is an perspective view of contrawound hemispherical conductors for a hemispherical form antenna.

Referring to FIG. 68, contrawound hemispherical conductors 234,236 for a hemispherical form antenna 238 having a hemispherical surface 240 on a plane 242 are illustrated. For the hemispherical embodiment, the equations describing the contrawound windings are developed by Equations 37–39 above where z is greater than or equal to zero. The conductor 234 extends in a first conductive path around and at least partially over the hemispherical surface 240 with at least a first winding sense (e.g., RH) and the conductor 236 extends in a second conductive path around and at least partially over the hemispherical surface 240 with at least a second winding sense (e.g., LH), in order that the conductors 234,236 are contrawound relative to each other around and at least partially over the hemispherical surface 240.

For clarity of description of the contrawound conductors and connections thereto, the plane 242 includes a left portion 244 and a fight portion 246. At about the center of the plane 242 are a pair of terminals A,B of which terminal A is offset for convenience of illustration. A plurality of feeds 248 are connected to the terminal A and plurality of feeds 250 are connected to the terminal B. The feeds 248,250 are preferably shielded and have the same electrical impedance.

Preferably, the plane 242 is a ground plane which reflects each winding electrically and creates a mirror image thereof. In this manner, if the hemispherical form antenna 238 is on the bottom of an airplane or on the top of a ear, then, from a distance, the radiation pattern thereof approximates that of a spherical antenna.

On the right portion 246 of the plane 242, the feeds 248,250 are connected to the conductors 236,234, respectively. On the left portion 244 of the plane 242, the feeds 248,250 are connected to the conductors 234,236, respectively. The exemplary hemispherical antenna 238 is useful in stimulating or detecting earth currents, such as those employed in geophysical exploration, and generally projects or receives energy equally in all directions above the plane 242 of FIG. 68.

Figure 69:
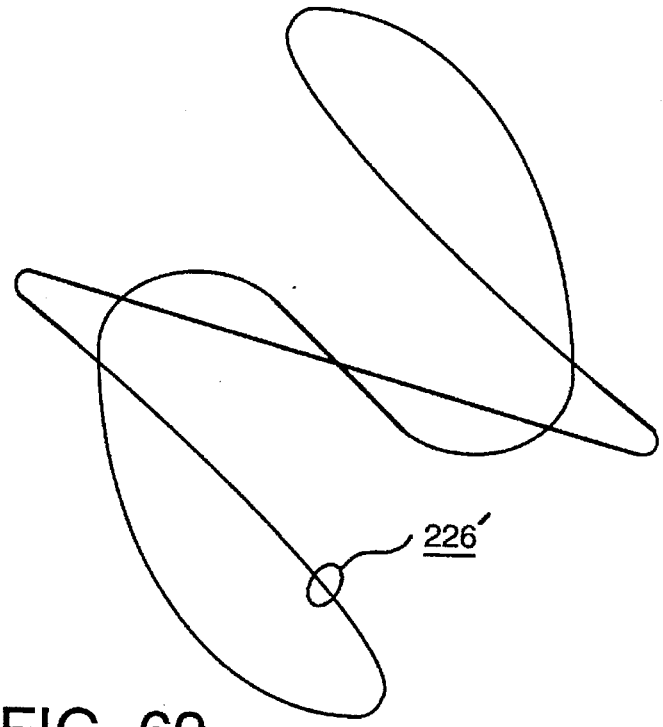
FIG. 69 is an perspective view of an alternative single spherical conductor for a spherical form antenna.
Figure 70:
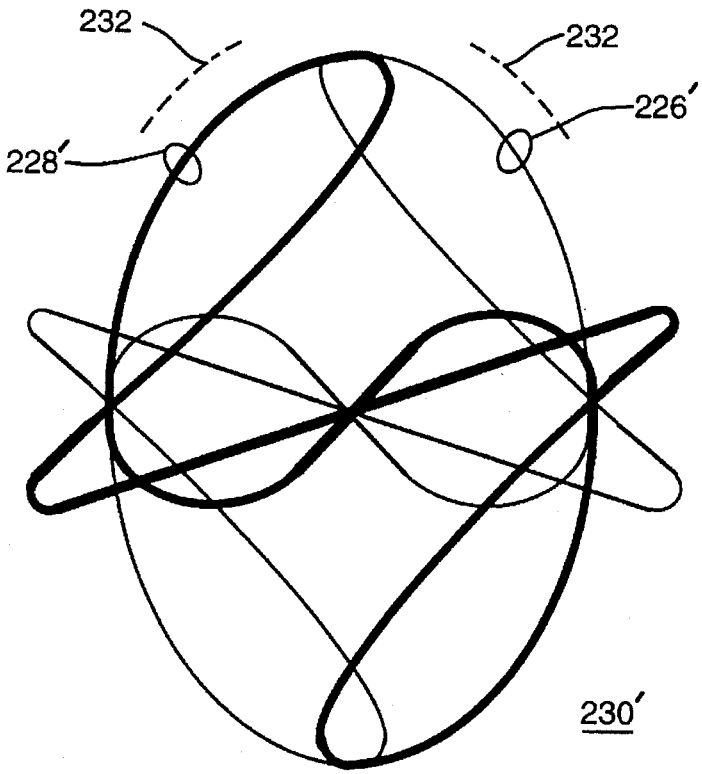
FIG. 70 is an perspective view of alternative contrawound spherical conductors for a spherical form antenna.

Referring to FIGS. 69 and 70, alternative contrawound spherical conductors 226',228' for the spherical surface 232 of FIG. 67 are illustrated. In this spherical embodiment, the spherical conductors 226',228' do not repeatedly cross at the poles as discussed in connection with FIG. 67. The antenna 230' is created, for example, by rotating the spherical surface 232 as the conductors 226',228' are applied.

Mathematically, a transformation matrix is introduced to operate on the position vector (x,y,z) defined by Equations 37–39. By applying the same transformation operator to both contrawound conductors 226',228' the transformation preserves the contrawound symmetry originally contained in the toroidal embodiment of Equations 34–36.

Equation 40 illustrates the general form of the transformed equations. The transformation matrix is, in general, a function of both $\phi$ and $\theta$.

$$\begin{bmatrix} X \\ Y \\ Z \end{bmatrix} = \begin{bmatrix} \tau_{11}(\theta,\phi) & \tau_{12}(\theta,\phi) & \tau_{13}(\theta,\phi) \\ \tau_{21}(\theta,\phi) & \tau_{22}(\theta,\phi) & \tau_{23}(\theta,\phi) \\ \tau_{31}(\theta,\phi) & \tau_{32}(\theta,\phi) & \tau_{33}(\theta,\phi) \end{bmatrix} \begin{bmatrix} x \\ y \\ z \end{bmatrix} \tag{40}$$

wherein:

(X,Y,Z): transformed coordinates (x,y,z): untransformed coordinates $\tau_{ij}$: general function of $\phi$ and $\theta$.

The transformation matrix of Equation 40 is defined as being any matrix which preserves the contrawound symmetry of the windings. For example, the geometry of the contrawound conductors 226',228' may be distorted by stretching or rotation, although the invention is applicable to any windings providing destructive interference in order to cancel the resulting electrical fields and constructive interference in order to reinforce the resulting magnetic fields. In order to illustrate this transformation an example will be provided.

$$\begin{bmatrix} X \\ Y \\ Z \end{bmatrix} = \begin{bmatrix} \cos\left(\frac{\theta}{2}\right) & 0 & \sin\left(\frac{\theta}{2}\right) \\ 0 & 1 & 0 \\ -\sin\left(\frac{\theta}{2}\right) & 0 & \cos\left(\frac{\theta}{2}\right) \end{bmatrix} \begin{bmatrix} x \\ y \\ z \end{bmatrix} \tag{41}$$

In this example, the spherical surface 232 is rotated in the XZ-plane as a function of $\theta$, although the invention is applicable to a wide range of transformations associated with toroidal surfaces, multiply connected surfaces, generally spherical surfaces and spherical surfaces.

Figure 71:
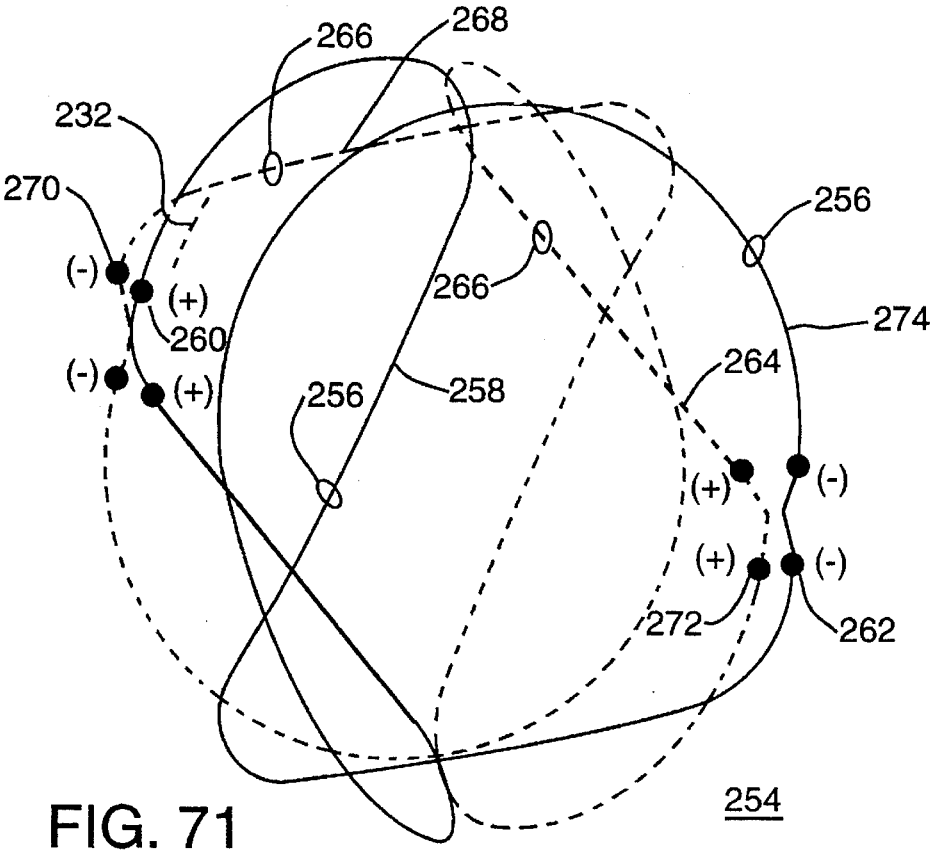
FIG. 71 is an perspective view of contrawound spherical conductors for a spherical form antenna with series or parallel feed-points.

Referring to FIG. 71, an antenna 254 having one or two feed ports is illustrated. The insulated conductor circuit 256 extends in the conductive path 258 around and partially over the surface 232 from a node 260 (+) to a node 262 (–). After changing winding sense at node 262 (–), the insulated conductor circuit 256 extends in the conductive path 274 around and partially over the surface 232 from the node 262

(–) to the node 260 (+) in order that the conductive paths 258,274 form an endless conductive path around and over the surface 232. The insulated conductor circuit 266 (shown in hidden line drawing) extends in the conductive path 268 around and partially over the surface 232 from a node 270 (–) to a node 272 (+). After changing winding sense at node 272 (+), the insulated conductor circuit 266 extends in the conductive path 264 around and partially over the surface 232 from the node 272 (+) to the node 270 (–) in order that the conductive paths 268,264 form another endless conductive path around and over the surface 232.

The exemplary antenna 254 provides transmission and reception of antenna signals. For example, in the case of a transmitted signal, the pair of endless conductive paths of the insulated conductor circuits 256,266 are fed in series from the nodes 272,262, although the invention is applicable to parallel feeds at both the nodes 272,262 and the nodes 260,270.

In addition to modifications and variations discussed or suggested previously, one skilled in the art may be able to make other modifications and variations without departing from the true scope and spirit of the invention.

I claim:

1. An electromagnetic antenna for use with an antenna signal, said electromagnetic antenna comprising:

a multiply connected surface;

first insulated conductor means extending in a first generally helical conductive path around and at least partially over said multiply connected surface with at least a first helical pitch sense;

second insulated conductor means extending in a second generally helical conductive path around and at least partially over said multiply connected surface with at least a second helical pitch sense which is opposite from the first helical pitch sense, in order that said first and second insulated conductor means are contrawound relative to each other around and at least partially over said multiply connected surface;

first and second signal terminals respectively electrically connected to said first and second insulated conductor means; and reflector means for directing said antenna signal with respect to said multiply connected surface for reception or transmission of the antenna signal.

2. The electromagnetic antenna of claim 1 wherein said reflector means includes a parabolic reflector.

3. The electromagnetic antenna of claim 2 wherein the parabolic reflector has a first opening, a generally parabolic shape which defines a vertex at about the first opening, and a second opening which is larger than the first opening; and wherein said multiply connected surface is located generally between the first and second openings of the parabolic reflector.

4. The electromagnetic antenna of claim 3 wherein the parabolic reflector further has a central axis between the first and second openings; and wherein said multiply connected surface has a major axis which is located generally along the central axis of the parabolic reflector.

5. The electromagnetic antenna of claim 4 wherein the parabolic reflector further has a focal point on the central axis thereof; and wherein said multiply connected surface is a toroidal surface having a major axis and a center thereon, with the center of the toroidal surface being located generally at the focal point of the parabolic reflector.

6. The electromagnetic antenna of claim 2 wherein said multiply connected surface is a toroidal surface; and wherein the parabolic reflector has a generally parabolic shape with a vertex and an opening; and wherein the toroidal surface is located generally between the vertex and the parabolic reflector opening.

7. The electromagnetic antenna of claim 2 wherein said multiply connected surface is a toroidal surface; wherein the parabolic reflector has a first opening, a generally parabolic shape which defines a vertex at about the first opening, and a second opening which is larger than the first opening; and wherein said toroidal surface is located generally between the first and second openings of the parabolic reflector.

8. The electromagnetic antenna of claim 2 wherein the parabolic reflector has a generally parabolic shape with a vertex and an opening; and wherein said multiply connected surface is located generally between the vertex and the parabolic reflector opening.

9. The electromagnetic antenna of claim 8 wherein the parabolic reflector further has an axis between the vertex and the opening; and wherein said multiply connected surface has a major axis which is located generally along the axis of the parabolic reflector.

10. The electromagnetic antenna of claim 9 wherein the parabolic reflector further has a focal point on the axis thereof; and wherein said multiply connected surface is a toroidal surface having a major axis and a center thereon, with the center of the toroidal surface being located generally at the focal point of the parabolic reflector.

11. The electromagnetic antenna of claim 1 wherein said first insulated conductor means extends in the first generally helical conductive path around and over said multiply connected surface with the first helical pitch sense from a first node to a second node; and wherein said second insulated conductor means extends in the second generally helical conductive path around and over said multiply connected surface with the second helical pitch sense from the second node to the first node in order that the first and second generally helical conductive paths are contrawound relative to each other and form a single endless conductive path around and over said multiply connected surface; and wherein said first and second signal terminals are respectively electrically connected to the first and second nodes.

12. The electromagnetic antenna of claim 1 wherein said first insulated conductor means extends in the first generally helical conductive path around and over said multiply connected surface with the first helical pitch sense from a first node to a second node and from the second node to a third node; wherein said second insulated conductor means extends in the second generally helical conductive path around and over said multiply connected surface with the second helical pitch sense from the third node to a fourth node and from the fourth node to the first node in order that the first and second generally helical conductive paths are contrawound relative to each other and form a single endless conductive path around and over said multiply connected surface; and wherein said first and second signal terminals are respectively electrically connected to the second and fourth nodes.

13. The electromagnetic antenna of claim 1 wherein said first insulated conductor means extends in the first generally helical conductive path around and partially over said multiply connected surface with the first helical pitch sense from a first node to a second node, and also extends in a third generally helical conductive path around and partially over said multiply connected surface with the second helical pitch sense from the second node to the first node in order that the first and third generally helical conductive paths form a first endless conductive path around and over said multiply connected surface; and wherein said second insulated conductor means extends in the second generally helical conductive path around and partially over said multiply connected surface with the second helical pitch sense from a third node to a fourth node, and also extends in a fourth generally helical conductive path around and partially over said multiply connected surface with the first helical pitch sense from the fourth node to the third node in order that the third and fourth generally helical conductive paths form a second endless conductive path around und and over said multiply connected surface, with the first and third generally helical conductive paths being contrawound relative to the second and fourth generally helical conductive paths, respectively; wherein said first signal terminal is electrically connected to the first node; and wherein said second signal terminal is electrically connected to the second node.

14. An electromagnetic antenna for use with an antenna signal, said electromagnetic antenna comprising:

a multiply connected surface having a major axis and at least one generally flat surface which is generally perpendicular to the major axis;

first insulated conductor means extending in a first partially helical conductive path around and at least partially over said multiply connected surface with at least a first helical pitch sense;

second insulated conductor means extending in a second partially helical conductive path around and at least partially over said multiply connected surface with at least a second helical pitch sense, which is opposite from the first helical pitch sense, in order that said first and second insulated conductor means are contrawound relative to each other around and at least partially over said multiply connected surface, with the first and second partially helical conductive paths, when generally perpendicular to the major axis of said multiply connected surface, being generally radial with respect to the major axis of said multiply connected surface, and otherwise being generally helically oriented; and first and second signal terminals respectively electrically connected to said first and second insulated conductor means.

15. The electromagnetic antenna of claim 14 wherein said multiply connected surface is a generally cylindrical surface.

16. The electromagnetic antenna of claim 14 wherein said multiply connected surface is a generally toroidal surface.

17. The electromagnetic antenna of claim 14 wherein said first insulated conductor means extends in the first partially helical conductive path around and over said multiply connected surface with the first helical pitch sense from a first node to a second node; and wherein said second insulated conductor means extends in the second partially helical conductive path around and over said multiply connected surface with the second helical pitch sense from the second node to the first node in order that the first and second partially helical conductive paths are contrawound relative to each other and form a single endless conductive path around and over said multiply connected surface; and wherein said first and second signal terminals are respectively electrically connected to the first and second nodes.

18. The electromagnetic antenna of claim 14 wherein said first insulated conductor means extends in the first partially helical conductive path around and over said multiply connected surface with the first helical pitch sense from a first node to a second node and from the second node to a third node; wherein said second insulated conductor means extends in the second partially helical conductive path around and over said multiply connected surface with the second helical pitch sense from the third node to a fourth node and from the fourth node to the first node in order that the first and second partially helical conductive paths are contrawound relative to each other and form a single endless conductive path around and over said multiply connected surface; and wherein said first and second signal terminals are respectively electrically connected to the second and fourth nodes.

19. An electromagnetic antenna for use with an antenna signal, said electromagnetic antenna comprising:

a multiply connected surface having a major axis;

first insulated conductor means extending in a first partially helical conductive path around and at least partially over said multiply connected surface with at least a first helical pitch sense;

second insulated conductor means extending in a second partially helical conductive path around and at least partially over said multiply connected surface with at least a second helical pitch sense, which is opposite from the first helical pitch sense, in order that said first and second insulated conductor means are contrawound relative to each other around and at least partially over said multiply connected surface, with the first and second partially helical conductive paths, when generally perpendicular to the major axis of said multiply connected surface, being generally radial with respect to the major axis of said multiply connected surface, and otherwise being generally helically oriented; and first and second signal terminals respectively electrically connected to said first and second insulated conductor means, wherein said first insulated conductor means extends in the partially helical conductive path around and partially over said multiply connected surface with the first helical pitch sense from a first node to a second node, and also extends in a third partially helical conductive path around and partially over said multiply connected surface with the second helical pitch sense from the second node to the first node in order that the first and third partially helical conductive paths form a first endless conductive path around and over said multiply connected surface; and wherein said second insulated conductor means extends in the second partially helical conductive path around and partially over said multiply connected surface with the second helical pitch sense from a third node to a fourth node, and also extends in a fourth partially helical conductive path around and partially over said multiply connected surface with the first helical pitch sense from the fourth node to the third node in order that the third and fourth partially helical conductive paths form a second endless conductive path around and over said multiply connected surface, with the first and third partially helical conductive paths being contrawound relative to the second and fourth partially helical conductive paths, respectively; wherein said first signal terminal is electrically connected to the first node; and wherein said second signal terminal is electrically connected to the second node.

20. An electromagnetic antenna for use with an antenna signal, said electromagnetic antenna comprising:

a generally spherical surface having a conduit along a major axis thereof;

first insulated conductor means extending in a first partially helical conductive path around and at least partially over said generally spherical surface with at least a first helical pitch sense;

second insulated conductor means extending in a second partially helical conductive path around and at least partially over said generally spherical surface with at least a second helical pitch sense, which is opposite from the first helical pitch sense, in order that said first and second insulated conductor means are contrawound relative to each other around and at least partially over said generally spherical surface, with the first and second partially helical conductive paths passing through the conduit of said generally spherical surface and being generally parallel to the major axis thereof within the conduit, and otherwise being generally helically oriented; and first and second signal terminals respectively electrically connected to said first and second insulated conductor means.

21. The electromagnetic antenna of claim 20 wherein said first insulated conductor means extends in the first partially helical conductive path around and over said generally spherical surface with the first helical pitch sense from a first node to a second node; and wherein said second insulated conductor means extends in the second partially helical conductive path around and over said generally spherical surface with the second helical pitch sense from the second node to the first node in order that the first and second partially helical conductive paths are contrawound relative to each other and form a single endless conductive path around and over said generally spherical surface; and wherein said first and second signal terminals are respectively electrically connected to the first and second nodes.

22. The electromagnetic antenna of claim 20 wherein said first insulated conductor means extends in the first partially helical conductive path around and over said generally spherical surface with the first helical pitch sense from a first node to a second node and from the second node to a third node; wherein said second insulated conductor means extends in the second partially helical conductive path around and over said generally spherical surface with the second helical pitch sense from the third node to a fourth node and from the fourth node to the first node in order that the first and second partially helical conductive paths are contrawound relative to each other and form a single endless conductive path around and over said generally spherical surface; and wherein said first and second signal terminals are respectively electrically connected to the second and fourth nodes.

23. The electromagnetic antenna of claim 20 wherein said first insulated conductor means extends in the first partially helical conductive path around and partially over said generally spherical surface with the first helical pitch sense from a first node to a second node, and also extends in a third partially helical conductive path around and partially over said generally spherical surface with the second helical pitch sense from the second node to the first node in order that the first and third partially helical conductive paths form a first endless conductive path around and over said generally spherical surface; and wherein said second insulated conductor means extends in the second partially helical conductive path around and partially over said generally spherical surface with the second helical pitch sense from a third node to a fourth node, and also extends in a fourth partially helical conductive path around and partially over said generally spherical surface with the first helical pitch sense from the fourth node to the third node in order that the third and fourth partially helical conductive paths form a second endless conductive path around and over said generally spherical surface, with the first and third partially helical conductive paths being contrawound relative to the second and fourth partially helical conductive paths, respectively; wherein said first signal terminal is electrically connected to the first node; and wherein said second signal is electrically connected to the second node.

24. An electromagnetic antenna for use with an antenna signal, said electromagnetic antenna comprising:

a multiply connected surface having a major radius which is greater than zero and a minor radius which is greater than the major radius;

first insulated conductor means extending in a first generally helical conductive path around and at least partially over said multiply connected surface with at least a first helical pitch sense;

second insulated conductor means extending in a second generally helical conductive path around and at least partially over said multiply connected surface with at least a second helical pitch sense, which is opposite from the first helical pitch sense, in order that said first and second insulated conductor means are contrawound relative to each other around and at least partially over said multiply connected surface; and first and second signal terminals respectively electrically connected to said first and second insulated conductor means.

25. The electromagnetic antenna of claim 24 wherein said first insulated conductor means extends in the first generally helical conductive path around and over said multiply connected surface with the first helical pitch sense from a first node to a second node; and wherein said second insulated conductor means extends in the second generally helical conductive path around and over said multiply connected surface with the second helical pitch sense from the second node to the first node in order that the first and second generally helical conductive paths are contrawound relative to each other and form a single endless conductive path around and over said multiply connected surface; and wherein said first and second signal terminals are respectively electrically connected to the first and second nodes.

26. The electromagnetic antenna of claim 24 wherein said first insulated conductor means extends in the first generally helical conductive path around and over said multiply connected surface with the first helical pitch sense from a first node to a second node and from the second node to a third node; wherein said second insulated conductor means extends in the second generally helical conductive path around and over said multiply connected surface with the second helical pitch sense, from the third node to a fourth node and from the fourth node to the first node in order that the first and second generally helical conductive paths are contrawound relative to each other and form a single endless conductive path around and over said multiply connected surface; and wherein said first and second signal terminals are respectively electrically connected to the second and fourth nodes.

27. The electromagnetic antenna of claim 24 wherein said first insulated conductor means extends in the first generally helical conductive path around and partially over said multiply connected surface with the first helical pitch sense from a first node to a second node, and also extends in a third generally helical conductive path around and partially over said multiply connected surface with the second helical pitch sense from the second node to the first node in order that the first and third generally helical conductive paths form a first endless conductive path around and over said multiply connected surface; and wherein said second insulated conductor means extends in the second generally helical conductive path around and partially over said multiply connected surface with the second helical pitch sense from a third node to a fourth node, and also extends in a fourth generally helical conductive path around and partially over said multiply connected surface with the first helical pitch sense from the fourth node to the third node in order that the third and fourth generally helical conductive paths form a second endless conductive path around and over said multiply connected surface, with the first and third generally helical conductive paths being contrawound relative to the second and fourth generally helical conductive paths, respectively; wherein said first signal terminal is electrically connected to the first node; and wherein said second signal terminal is electrically connected to the second node.

28. The electromagnetic antenna of claim 24 wherein said first insulated conductor means extends in the first generally helical conductive path around and over said multiply connected surface and forms a first endless conductive path around and over said multiply connected surface, with the first generally helical conductive path having a first helical pitch sense and a second helical pitch sense, which is opposite from the first helical pitch sense; wherein said second insulated conductor means extends in the second generally helical conductive path around and over said multiply connected surface and forms a second endless conductive path around and over said multiply connected surface, with the second generally helical conductive path having the first and second helical pitch senses; wherein said first and second insulated conductor means are contrawound relative to each other in each of a plurality of adjacent multiply connected surface segments extending around said multiply connected surface, with each of the segments being defined by a first node at which one of said first and second insulated conductor means changes from the first to the second helical pitch sense, and a second node at which the other of said first and second insulated conductor means changes from the second to the first helical pitch sense; wherein said first signal terminal is electrically connected to the first nodes at a first substantially common point; and wherein said second signal terminal is electrically connected to the second nodes at a second substantially common point.

29. The electromagnetic antenna of claim 28 wherein said multiply connected surface is a surface of a toroidal form having a major axis; and wherein the first and second substantially common points are located generally along the major axis of the toroid form.

30. An electromagnetic antenna for use with an antenna signal, said electromagnetic antenna comprising:

a spherical surface;

first insulated conductor means extending in a first conductive path around and at least partially over said spherical surface with at least a first winding sense;

second insulated conductor means exuding in a second conductive path around and at least partially over said spherical surface with at least a second winding sense, which is opposite from the first winding sense, in order that said first and second insulated conductor means are contrawound relative to each other around and at least partially over said spherical surface; and first and second signal terminals respectively electrically connected to said first and second insulated conductor means.

31. The electromagnetic antenna of claim 30 wherein said first insulated conductor means extends in the first conductive path around and over said spherical surface with the first winding sense from a first node to a second node; and wherein said second insulated conductor means extends in the second conductive path around and over said spherical surface with the second winding sense from the second node to the first node in order that the first and second conductive paths are contrawound relative to each other and form a single endless conductive path around and over said spherical surface; and wherein said first and second signal terminals are respectively electrically connected to the first and second nodes.

32. The electromagnetic antenna of claim 30 wherein said first insulated conductor means extends in the first conductive path around and over said spherical surface with the first winding sense from a first node to a second node and from the second node to a third node; wherein said second insulated conductor means extends in the second conductive path around and over said spherical surface with the second winding sense from the third node to a fourth node and from the fourth node to the first node in order that the first and second conductive paths are contrawound relative to each other and form a single endless conductive path around and over said spherical surface; and wherein said first and second signal terminals are respectively electrically connected to the second and fourth nodes.

33. The electromagnetic antenna of claim 30 wherein said first insulated conductor means extends in the first conductive path around and partially over said spherical surface with the first winding sense from a first node to a second node, and also extends in a third conductive path around and partially over said spherical surface with the second winding sense from the second node to the first node in order that the first and third conductive paths form a first endless conductive path around and over said spherical surface; and wherein said second insulated conductor means extends in the second conductive path around and partially over said spherical surface with the second winding sense from a third node to a fourth node, and also extends in a fourth conductive path around and partially over said spherical surface with the first winding sense from the fourth node to the third node in order that the third and fourth conductive paths form a second endless conductive path around and over said spherical surface, with the first and third conductive paths being contrawound relative to the second and fourth conductive paths, respectively; wherein said first signal terminal is electrically connected to the first node; and wherein said second signal terminal is electrically connected to the second node.

34. The electromagnetic antenna of claim 30 wherein said spherical surface has a pair of poles; and wherein the first and second conductive paths generally intersect at each of the poles.

35. The electromagnetic antenna of claim 30 wherein said spherical surface has a pair of poles; and wherein the first and second conductive paths generally intersect away from each of the poles.

36. An electromagnetic antenna for use with an antenna signal, said electromagnetic antenna comprising:

a hemispherical surface;

first insulated conductor means extending in a first conductive path around and at least partially over said hemispherical surface with at least a first winding sense;

second insulated conductor means extending in a second conductive path around and at least partially over said hemispherical surface with at least a second winding sense, which is opposite from the first winding sense, in order that said first and second insulated conductor means are contrawound relative to each other around and at least partially over said hemispherical surface; and first and second signal terminals respectively electrically connected to said first and second insulated conductor means.

37. The electromagnetic antenna of claim 36 wherein said first insulated conductor means extends in the first conductive path around and over said hemispherical surface with the first winding sense from a first node to a second node; and wherein said second insulated conductor means extends in the second conductive path around and over said hemispherical surface with the second winding sense from the second node to the first node in order that the first and second conductive paths are contrawound relative to each other and form a single endless conductive path around and over said hemispherical surface; and wherein said first and second signal terminals are respectively electrically connected to the first and second nodes.

38. The electromagnetic antenna of claim 36 wherein said first insulated conductor means extends in the first conductive path around and over said hemispherical surface with the first winding sense from a first node to a second node and from the second node to a third node; wherein said second insulated conductor means extends in the second conductive path around and over said hemispherical surface with the second winding sense from the third node to a fourth node and from the fourth node to the first node in order that the first and second conductive paths are contrawound relative to each other and form a single endless conductive path around and over said hemispherical surface; and wherein said first and second signal terminals are respectively electrically connected to the second and fourth nodes.

39. The electromagnetic antenna of claim 36 wherein said first insulated conductor means extends in the first conductive path around and partially over said hemispherical surface with the first winding sense from a first node to a second node, and also extends in a third conductive path around and partially over said hemispherical surface with the second winding sense from the second node to the first node in order that the first and third conductive paths form a first endless conductive path around and over said hemispherical surface; and wherein said second insulated conductor means extends in the second conductive path around and partially over said hemispherical surface with the second winding sense from a third node to a fourth node, and also extends in a fourth conductive path around and partially over said hemispherical surface with the first winding sense from the fourth node to the third node in order that the third and fourth conductive paths form a second endless conductive path around and over said hemispherical surface, with the first and third conductive paths being contrawound relative to the second and fourth conductive paths, respectively; wherein said first signal terminal is electrically connected to the first node; and wherein said second signal terminal is electrically connected to the second node.

40. The electromagnetic antenna of claim 36 wherein said hemispherical surface includes a planar surface associated with said first and second signal terminal.

41. The electromagnetic antenna of claim 40 wherein the planar surface is a ground plane.

* * * * *